US006183228B1

(12) United States Patent
Machida et al.

(10) Patent No.: US 6,183,228 B1
(45) Date of Patent: Feb. 6, 2001

(54) DISPLACEMENT TYPE FLUID MACHINE

(75) Inventors: Shigeru Machida; Hirokatsu Kohsokabe; Shunichi Mitsuya; Yuji Yoshitomi, all of Ibaraki-ken; Masahiro Takebayashi, Tsuchiura; Koichi Inaba; Hiroaki Hata, both of Tochigi-ken, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/124,234

(22) Filed: Jul. 29, 1998

(30) Foreign Application Priority Data

Jul. 31, 1997 (JP) ..... 9-205827

(51) Int. Cl.[7] ..... F03C 2/00
(52) U.S. Cl. ..... 418/61.1; 418/55.3
(58) Field of Search ..... 418/61.1, 55.3

(56) References Cited

U.S. PATENT DOCUMENTS

| | | | | |
|---|---|---|---|---|
| 2,112,890 | | 4/1938 | Gunn . | |
| 4,253,806 | * | 3/1981 | D'Amato | 418/61.1 |
| 4,948,344 | * | 8/1990 | Cygnor | 418/279 |
| 5,788,470 | * | 8/1998 | Okuda et al. | 418/55.2 |

FOREIGN PATENT DOCUMENTS

| | | |
|---|---|---|
| 232199 | 8/1994 | (CH) . |
| 508011 | 9/1930 | (DE) . |
| 55-23353 | 2/1980 | (JP) . |
| 5-202869 | 8/1993 | (JP) . |
| 6-280758 | 10/1994 | (JP) . |

OTHER PUBLICATIONS

U.S. application No. 08/791,959.

* cited by examiner

*Primary Examiner*—Thomas Denion
*Assistant Examiner*—Thai Ba Trieu
(74) *Attorney, Agent, or Firm*—Antonelli, Terry, Stout & Kraus, LLP

(57) ABSTRACT

A displacement type fluid machine in which a displacer and a cylinder are disposed between end plates, a space is formed by an inner wall surface of the cylinder and an outer wall surface of the displacer when the center of the displacer is put on the center of the cylinder, and a plurality of spaces is formed when the positional relationship between the displacer and the cylinder is for a gyration, is restrained from deterioration of the efficiency. One of the end plates and a vane protruding inwardly from the inside surface of the cylinder are fixed to each other so as to restrain the deformation of the vane and decrease the leakage of a working fluid due to the deformation.

4 Claims, 20 Drawing Sheets

DISPLACEMENT TYPE FLUID MACHINE

TECHNICAL FIELD

The present invention relates to, for example, a pump, a compressor, an expander, etc., more specifically to a displacement type fluid machine.

BACKGROUND ART

As a conventional displacement type fluid machine, a reciprocating fluid machine for moving a working fluid by repeating a reciprocation of a piston in a cylindrical cylinder, a rotary (rolling piston type) fluid machine for moving a working fluid by eccentrically rotating a cylindrical piston in a cylindrical cylinder, a scroll fluid machine for moving a working fluid by engaging a pair of fixed scroll and orbiting scroll, which have spiral wraps and stand up on end plates, with each other and by gyrating the orbiting scroll, are well known.

Since the reciprocating fluid machine is simply constructed, it is possible to prepare the machine easily and to be inexpensive. On the other hand, since the process from suction completion to discharge completion is short of the shaft angle of 180° so that a flow velocity of the process for the discharge gets faster, there is a problem that the pressure loss is increased so that the performance is reduced. Further, since it is necessary to reciprocate the piston, so that a rotary shaft system can not be completely balanced, there is another problem that a vibration and a noise are larger.

Also, in case of the rotary fluid machine, since the process from suction completion to discharge completion has the shaft angle of 360°, there is less problem that the pressure loss during the discharge process is increased compared to the reciprocating fluid machine. However, since the working fluid is discharged once per one rotation of the shaft, the variation of a gas compression torque is relatively higher, accordingly, there is the same problem of the vibration and noise as the reciprocating fluid machine.

Further, in case of the scroll fluid machine, since the process from suction completion to discharge completion has the long shaft angle of 360° or more (the scroll fluid machine practically used as an air conditioner has usually 900°), so that the pressure loss during the process of discharge is low, a plurality of working chambers are formed generally, so that there is an advantage that the variation of the gas compression torque is low and the vibration and noise are less. When the wraps are engaged, it is necessary to manage the clearance between the spiral wraps and the clearance between the end plate and a wrap tip. Thus, the fluid machine must be worked with high accuracy, so that there is further problem that the expense of working is expensive. Further, since the process from suction completion to discharge completion has the long shaft angle of 360° or more, it takes a long time for the compression process, so that there is further problem that the internal leakage is increased.

By the way, known is a displacement type fluid machine in which a displacer for moving a working fluid is not rotated relative to a cylinder in which the working fluid is suctioned, but is gyrated with an almost constant radius, that is, is gyrated to transmit the working fluid. This kind of displacement type fluid machines have been proposed in Japanese Patent Unexamined Publication No. 55-23353 (Document 1), U.S. Pat. No. 2,112,890 (Document 2), Japanese Patent Unexamined Publication No. 5-202869 (Document 3) and Japanese Patent Unexamined Publication No. 6-280758 (Document 4). Such a displacement type fluid machine as proposed therein comprises a petal-shaped piston having a plurality of members (vanes) radially extending from the center and a cylinder having a hollow portion of almost the same shape as the piston, wherein the piston is gyrated in the cylinder so as to move the working fluid.

DISCLOSURE OF THE INVENTION

Since Such a displacement type fluid machine as shown in the Documents 1 to 4 do not have a portion for reciprocation unlike the reciprocating fluid machine, it is possible to balance the rotary shaft system completely. Thus, since the vibration is low, further the sliding velocity between the piston and the cylinder is low, the displacement type fluid machine is essentially provided with an advantageous characteristic that it is possible to reduce the friction loss.

However, the process from suction completion to discharge completion in each working chamber formed by plural vanes, which constitute a piston, and the cylinder has the short shaft angle θc of about 180° (210°) (about a half of that of a rotary fluid machine and the same level as a reciprocating fluid machine), the flow velocity during the discharge process gets faster, there is further problem that the pressure loss is increased, so that the performance is reduced. Also, in such fluid machines as described in those Documents, the shaft angle from a suction completion to a discharge completion in each working chamber is small and a time lag is occurred for the duration from the discharge completion to the next (compression) process (another suction completion) start and the working chamber from the suction completion to the discharge completion is one-sided around a drive shaft to be formed. Therefore, such a fluid machine is not dynamically balanced and a rotating moment for prompting the piston itself to be rotated is excessively applied to the piston as a reaction from the compressed working fluid, thereby there is further problem in reliability that the friction and abrasion of the vanes are occurred.

For solving this problem, developed was a displacement type fluid machine in which a displacer and a cylinder are located between end plates, a space is formed by an inner wall surface of said cylinder and an outer wall surface of said displacer when the center of said displacer is located on the center of said cylinder, and a plurality of spaces are formed when the positional relationship between said displacer and said cylinder is for a gyration, wherein said inner wall surface of said cylinder and said outer wall surface of said displacer are formed so that the maximum value of the number of spaces among said plurality of spaces in the process from a suction completion to a discharge completion is not less than the number of protrusions protruding inwardly of said cylinder (a displacement type fluid machine in which a displacer and a cylinder are located between end plates, a space is formed by an inner wall surface of said cylinder and an outer wall surface of said displacer when the center of said displacer is located on the center of said cylinder, and a plurality of spaces are formed when the positional relationship between said displacer and said cylinder is for a gyration, wherein said inner wall surface of said cylinder and said outer wall surface of said displacer are formed so that the shaft angle θc in the process from a suction completion to a discharge completion in said plurality of spaces satisfies the following expression:

$$(((N-1)/N\cdot 360)<\theta c\leqq 375 \text{ (degree)}$$

where N is the number of protrusions protruding inwardly of said cylinder. This displacement type fluid machine has characteristics that the fluid loss in the discharge process can be decreased to the extent of that of a scroll fluid machine and the manufacture is easier than that of the scroll fluid machine.

By the way, when a displacement type fluid machine in which a displacer and a cylinder are located between end plates, a space is formed by an inner wall surface of said cylinder and an outer wall surface of said displacer when the center of said displacer is located on the center of said cylinder, and a plurality of spaces are formed when the positional relationship between said displacer and said cylinder is for a gyration, as described in the above documents including the above developed one, is operated as a compressor, a problem arose that the whole adiabatic efficiency lowered especially in a high speed range.

An object of the present invention is to provide a displacement type fluid machine in which the deterioration of the performance can be restrained in a practical operation.

The above object is attained by a displacement type fluid machine in which a displacer and a cylinder having protrusions protruding inwardly are located between end plates, a space is formed by an inner wall surface of said cylinder and an outer wall surface of said displacer when the center of said displacer is located on the center of said cylinder, and a plurality of spaces are formed when the positional relationship between said displacer and said cylinder is for a gyration, wherein at least one of said end plates and said protrusions are fixed.

BEST MODE FOR CARRYING OUT THE INVENTION

Figure 1A:
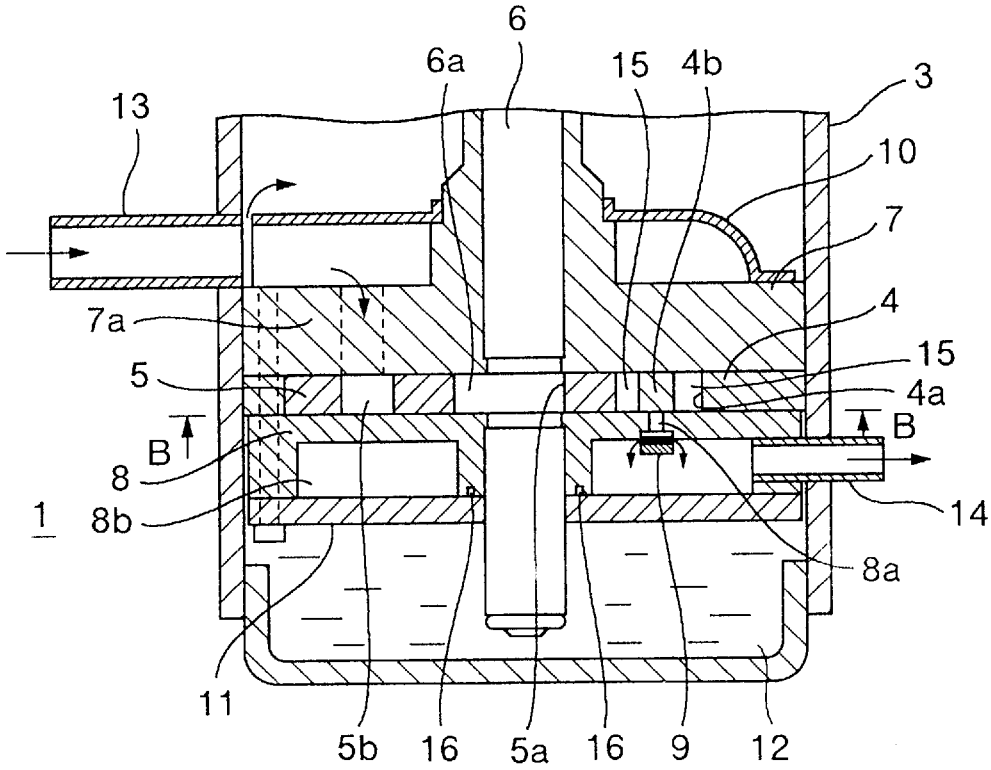
FIGS. 1 are a vertical sectional view and a plan view of a compression element of a sealed-type compressor in case that a displacement type fluid machine according to the present invention is applied to the compressor.
Figure 1B:
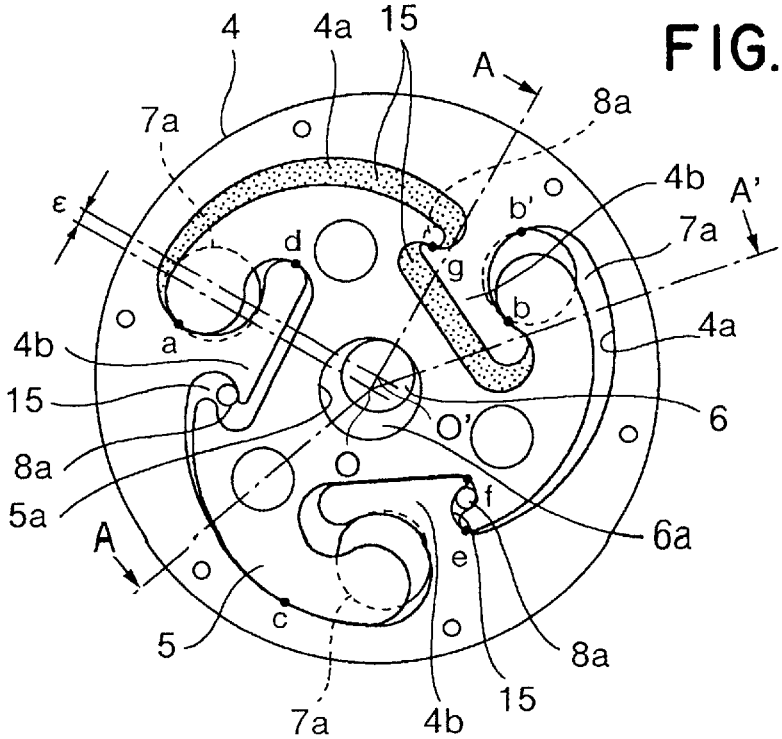
Figure 2:
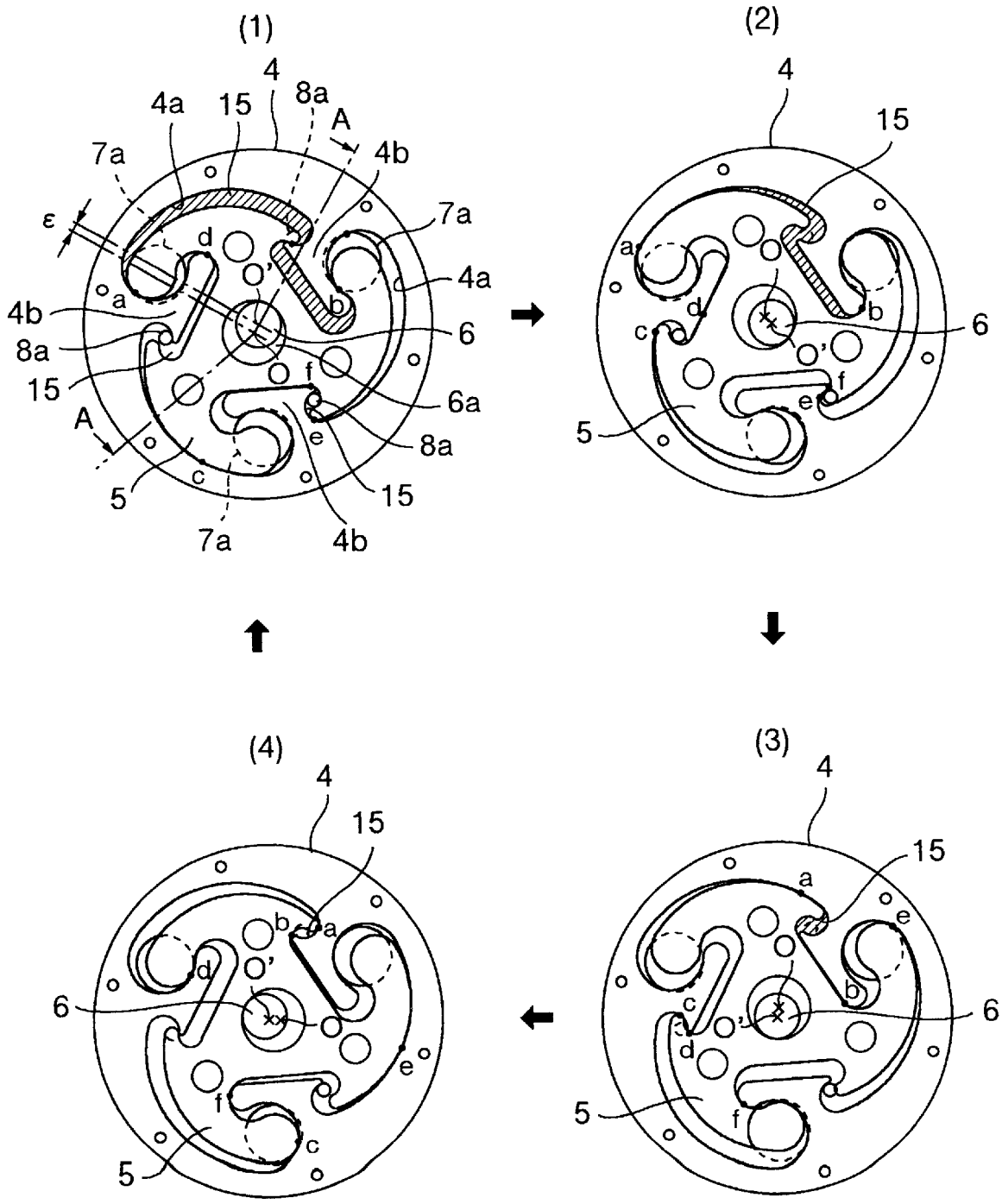
FIGS. 2 are views for explaining the principle of the work of the displacement type fluid machine according to the present invention.
Figure 3:
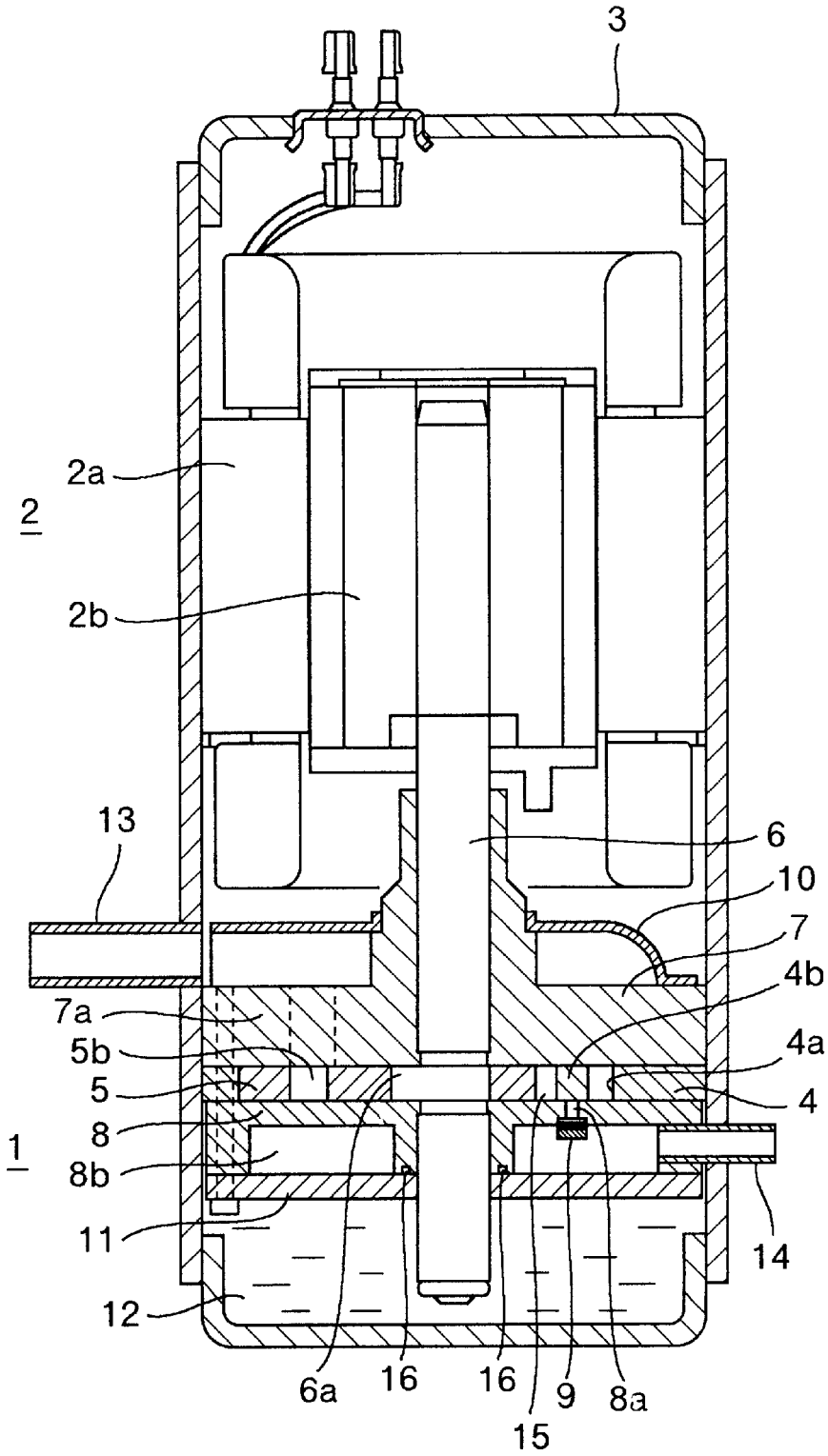
FIG. 3 is a longitudinal sectional view of the displacement type fluid machine according to the present invention.

The above-described features of the present invention will be understood more clearly in reference to the following embodiments. An embodiment of the present invention will be explained below in reference to drawings. First, the construction of a displacement type fluid machine as an embodiment of the present invention will be explained with reference to FIGS. 1 to 3. FIG. 1(*a*) is a vertical sectional view of the principal part of a sealed-type compressor in case that a displacement type fluid machine as an embodiment of the present invention is used as a compressor (a sectional view taken along line A—A in (b)) and (b) is a plan view showing the state of forming a working chamber along arrows B—B in (a). FIGS. 2 are views for illustrating the principle of the work of a displacement type compression element. FIG. 3 is a vertical sectional view of the sealed-type compressor in case that the displacement type fluid machine as an embodiment of the present invention is used as a compressor.

In FIGS. 1, a displacement type compression element 1 and a motor element 2 (element 2 shown in FIG. 3) for driving the displacement type compression element 1 are accommodated in a sealed container 3. The displacement type compression element 1 will be explained in detail. A three-threaded wrap comprising a combination of three sets of the same contour shapes is shown in FIG. 1(*b*). The shape of the inner periphery of a cylinder 4 is formed so that each hollow appears for every 120° (the center is o') in the same shape. An end portion of each hollow has a plurality of vanes 4*b* (in this case, three vanes because of the three-threaded wrap) protruding inward. A displacer 5 is located within the cylinder 4 so that their centers are distant from each other by $\epsilon$. The displacer 5 is constructed so as to engage with an inner peripheral wall 4*a* (a portion having more curvature than the vane 4*b*) of the cylinder 4 and the vane 4*b*. When the center o' of the cylinder 4 corresponds to the center o of the displacer 5, a distance having a constant width is formed between both of contour shapes.

Next, the principle of working the displacement type compression element 1 will be explained in reference to FIGS. 1 and 2. A reference o denotes the center of the displacer 5. A reference o' denotes the center of the cylinder 4 (or a rotary shaft 6). References a, b, c, d, e, and f denote engaging points where the inner peripheral wall 4*a* of the cylinder 4 and the vane 4*b* are engaged with the displacer 5. The same combinations of curves are smoothly connected at three points so that the shape of the inner peripheral contour is formed. Viewing one combination, a curve forming the inner peripheral wall 4*a* and the vane 4*b* is considered as one vortex curve having a thickness (the vortex starts from the end of the vane 4*b*). The inner wall curve (g-a) is a vortex curve whose wrap angle, which is the amount of arc angles constituting the curve, is substantially 360° (although the inner wall curve is designed in order to obtain the wrap angle of 360°, since the angle of 360° is not precisely set due to a preparing error, the expression "substantially 360°" is used. Accordingly, the expression "substantially 360°" will be similarly used below. The wrap angle will be described below in detail.). The outer curve (g-b) is a vortex curve having the wrap angle of substantially 360°. The inner peripheral contour of one combination is shaped by the inner wall curve and the outer wall curve. Spiral bodies are arranged on a circle at substantially equal pitch (in this case, the pitch is 120° because of the three-threaded wrap) and are adjacent to each other. The outer wall curve of a spiral body is connected to the inner wall curve of adjacent spiral body by a smooth connection curve (b–b') such as arc etc. so that the inner peripheral contour of the cylinder 4 is shaped. The outer peripheral contour of the displacer 5 is also shaped by the principle similarly to the cylinder 4.

As described above, the spiral bodies comprising three curves are arranged on the periphery at substantially equal pitch (120°). The object of the equal pitch is to allow equally to disperse load accompanied with a compression operation described below and further easily to prepare. Accordingly, if it is not especially essential to disperse the equal load and easily to prepare, an unequal pitch may be set.

A compression operation by using the cylinder 4 and the displacer 5 as constructed above will be explained in reference to FIGS. 2. A numeral 7*a* denotes a suction port and a numeral 8*a* denotes a discharge port, each arranged at three positions of the corresponding end plate. The rotary shaft 6 is rotated so that the displacer 5 is not rotated around the center o' of the fixed cylinder 4, but is orbited by a rotary radius δ (=oo'). A plurality of compression working chambers 15 are formed around the center o' of the displacer 5 (in this embodiment, three working chambers are always formed.). Here, the working chamber is the space of which suction is completed and compression (discharge) is started among a plurality of spaces surrounded and sealed by the inner peripheral contour (inner wall) of the cylinder and the outer peripheral contour (side wall) of the piston, that is, the space of which operation condition is in a period from the suction completion till discharge completion. In case that the above wrap angle is 360°, this space does not exist at the compression completion but the suction is also completed, and therefore, this space is counted and defined as one space. In case of using the machine as the pump, the working chamber is the space communicated with an outward portion via the discharge port. An explanation will be given in reference to one compression working chamber surrounded by the engaging points a and b and hatched. Although this working chamber is divided into two parts at the suction completion, two parts of working chamber are immediately communicated with each other at the compression process start. FIG. 2(1) shows a state that the working gas suction from the suction port 7*a* to this working chamber is completed. FIG. 2(2) shows a state that the rotary shaft 6 is rotated in 90° from the state shown in FIG. 2(1). FIG. 2(3) shows a state that the drive shaft 6 is further rotated in 180° from the state shown in FIG. 2(1). FIG. 2(4) shows a state that the drive shaft 6 is further rotated in 270° from the state shown in FIG. 2(1). When the drive shaft 6 shown in FIG. 2(4) is further rotated in 90°, the drive shaft 6 returns back to the state shown in FIG. 2(1). Thus, as the drive shaft 6 is rotated, the volume of the working chamber 15 is reduced. Since the discharge port 8*a* is closed by a discharge valve 9 (shown in FIGS. 1), the working fluid is compressed. When the pressure in the working chamber 15 becomes higher than an outer discharge pressure, the discharge valve 9 is automatically opened by the pressure difference, so that the compressed working gas is discharged through the discharge port 8*a*. The rotational angle of the rotary shaft from the suction completion (the compression start) to the discharge completion is 360°. The next suction process is prepared during each compression and discharge process is being carried out. The next compression process is started at the suction completion. For example, taking the example of the space formed by the engaging points a and b, at the step shown in FIG. 2(1), the suction is already started from the suction port 7*a*. As the rotation is further carried out, the volume of the space is increased. When the process proceeds to the state shown in FIG. 2(4), this space is divided. The fluid corresponding to the divided amount is compensated by the space formed by the engaging points b and e.

A detailed explanation of the compensation manner will be described below. Taking the example of the working chamber formed by the engaging points a and b in the state shown in FIG. 2(1), the suction has been started in the space formed by the adjacent engaging points a and d. This space is once expanded as shown in FIG. 2(3), and thereafter this space is divided by a connection point d in the state shown in FIG. 2(4). Accordingly, all the fluid in the space formed by the engaging points a and d is not compressed by the space formed by the engaging points a and b. The fluid as much as the fluid volume which is separated and not taken in the space formed by the engaging points a and d is applied by the fluid flowing into a space formed by the engaging points e and b in the vicinity of the discharge port after a space formed by the engaging points b and e and in suction process in FIG. 2(4) is divided by a connection point b as shown in FIG. 2(1). As described above, the wrap bodies are arranged at the equal pitch. That is, since the displacer and the cylinder are shaped by a repetition of the same contour shape, it is possible to compress substantially the same volume of fluid even if any working chamber is provided with the fluid from different spaces. Even in case of unequal pitch, it is possible to work so that the volume formed in each space can be equal, but the productivity becomes wrong. According to any prior art as described above, the space during the suction process is closed and the internal fluid is compressed and discharged. On the other hand, according to one aspect of the embodiment of the present invention, the space in the suction process adjacent to the working chamber is divided and performs compression. This is one of the features of the invention.

As explained above, the working chambers for continuously compressing are dispersed and arranged around a crank portion 6*a* of the rotary shaft 6 located at the center of the displacer 5 at substantially equal pitch and the working chambers perform compressions with different phases. That is, in one space, the rotational angle of the rotary shaft from the suction to the discharge is 360°, but in case of the embodiment, three working chambers are formed and discharge with shifted phase of 120°. Accordingly, in case of operating as a compressor compressing a gas as a fluid, the compressed gas is discharged three times during the rotational angle of 360° of the rotary shaft.

Consider the space in the instant of the compression completion (the space surrounded by the engaging points a and b) as one space. In case of the wrap angle of 360° such as the embodiment, whenever the compressor is operated, it is designed so that the space for the suction process and the space for the compression process are alternately located. Thus, it is possible to proceed to the next compression process immediately in the instant of the compression process and to compress the fluid smoothly and continuously.

Next, the compressor incorporating the displacement type compression element 1 having the shape as described above will be explained in reference to FIGS. 1 and 3. As shown in FIG. 3, the displacement type compression element 1 has the cylinder 4 and the displacer 5 as described above in detail, further, a rotary shaft 6 for driving the displacer 5 with a crank portion 6*a* engaging with the bearing at the center of the displacer 5, a main bearing member 7 and an auxiliary bearing member 8 performing end plates for closing opening portions at both ends of the cylinder 4 and bearing for supporting the rotary shaft 6, a suction port 7*a* formed on the end plate of the main bearing member 7, a discharge port 8*a* formed on the end plate of the auxiliary bearing member 8, and a discharge valve 9 (opened and closed by a differential pressure) for opening and closing the discharge port 8*a*. But the discharge valve 9 may be a lead valve type. On the other hand, the surface of the rotary shaft 6 or the surface of each bearing member for supporting the shaft in a rotatable manner is given a surface treatment for decreasing the friction loss due to sliding movement. Otherwise, a bearing part made of a material different from those of the rotary shaft 6 and the bearing members 7 and 8 may be inserted between them. Further, the fitting portion between the rotary shaft 6 and the displacer 5 is constructed similarly to the above. Also, a numeral 5*b* denotes a through hole bored through the displacer 5. A numeral 10 denotes a suction cover mounted to the main bearing member 7. A numeral 11 denotes a discharge cover for forming a discharge chamber 8*b* integrated with the auxiliary bearing member 8.

A motor element 2 comprises a stator 2*a* and a rotor 2*b*. The rotor 2*b* is, for example, fixed to one end of the drive shaft 6 by shrinkage fit. In order to enhance the motor efficiency, the motor element 2 comprises a brushless motor whose drive is controlled by a three-phase inverter. Another motor type, for example, a DC motor or an induction motor may be applied.

A numeral 12 denotes a lubricating oil stored at a bottom portion in the sealed container 3. A lower end portion of the rotary shaft 6 is soaked into the lubricating oil. A numeral 13 denotes a suction pipe. A numeral 14 denotes a discharge pipe. A numeral 15 denotes the above-described working chambers formed by engagement of the inner peripheral wall 4*a* and vanes 4*b* with the displacer 5. Also, the discharge chamber is separated from the pressure in the sealed container 3 by a sealing member 16 such as an O ring.

A flow of the working gas (coolant gas) in case that the displacement type fluid machine according to this embodiment is used as a compressor for air conditioning will be described with reference to FIGS. 1. As shown by an arrow in FIGS. 1, the working gas passes through the suction pipe 13, enters into the suction cover 10 mounted to the main bearing member 7, and enters into the displacement type compression element 1 through the suction port 7*a,* where the rotary shaft 6 is rotated for gyrating the displacer 5 so that the volume in the working chamber is reduced to compress the working gas. The compressed working gas passes through the discharge port 8*a* formed on the end plate of the auxiliary bearing member 8, pushes up the discharge valve 9, enters into the discharge chamber 8*b,* passes through the discharge pipe 14, and flows outwardly. The distance is formed between the suction pipe 13 and the suction cover 10 to allow the working gas to pass through into the motor element 2 to cool the motor element, and to keep the pressure in the sealed container 3 low. The lubricating oil 12 stored in the sealed container 3 is sent by a differential pressure or a centrifugal pump lubrication from the bottom portion through a hole formed in the interior of the rotary shaft 6 to each sliding portion for lubrication. A part of it is also supplied to the interior of the working chamber through a gap between the displacer and the end plates.

Figure 5A:
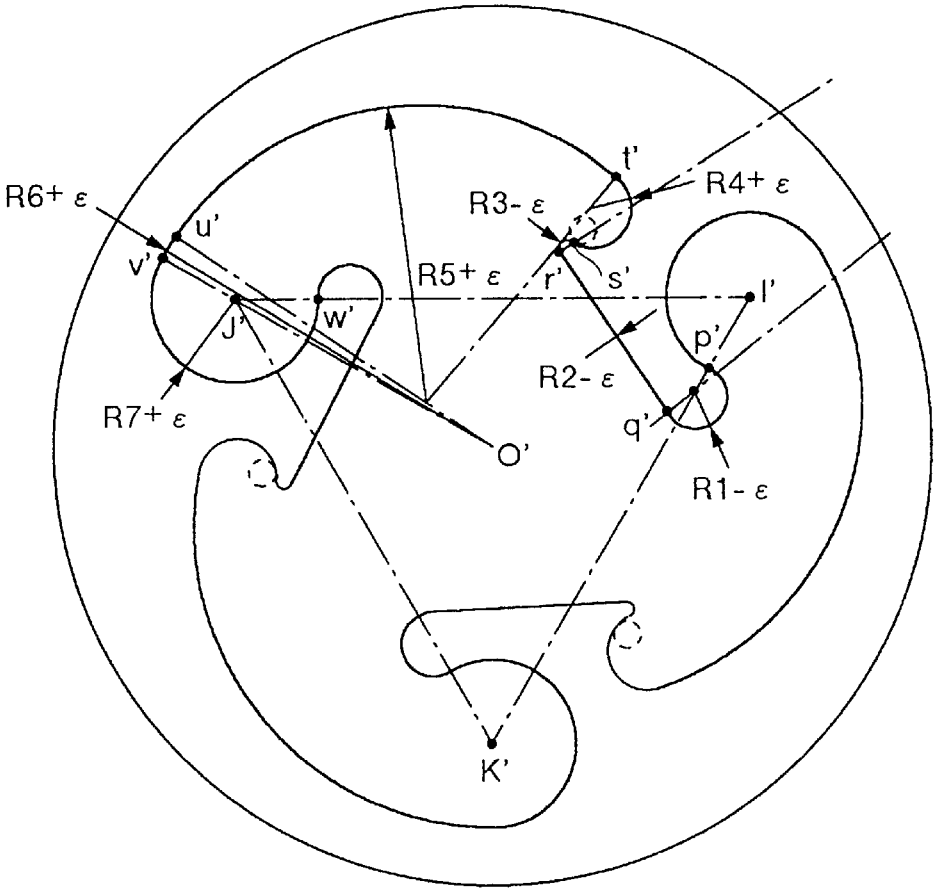
FIGS. 5 are views showing a construction of contours of the cylinder of the displacement type fluid machine according to the present invention.
Figure 5B:
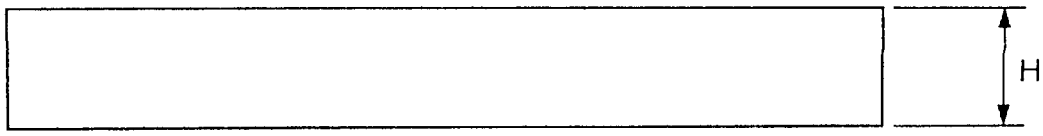
Figure 6:
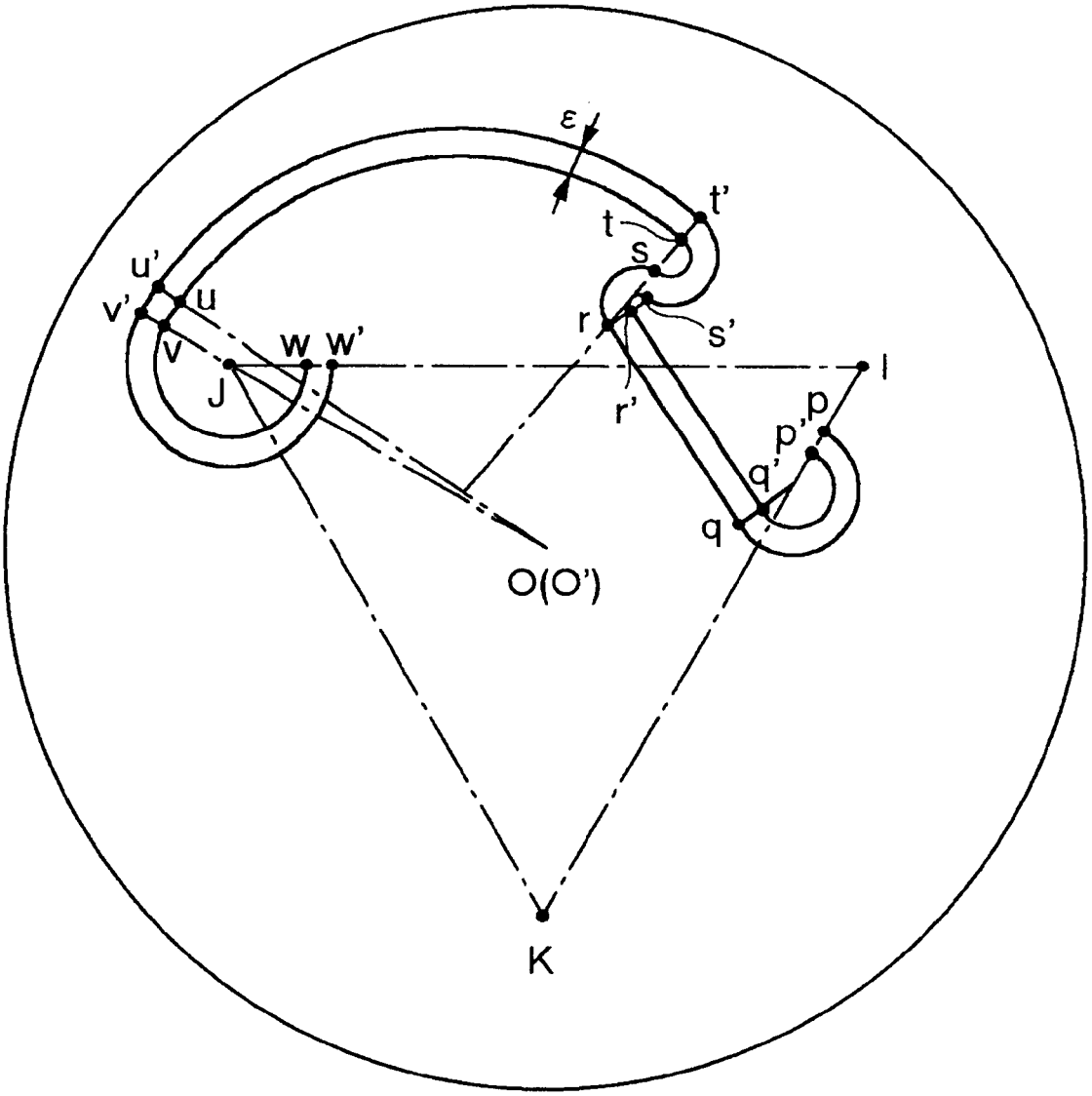
FIG. 6 is a view of the displacer shown in FIGS. 4 and the cylinder shown in FIGS. 5, in which the former is superimposed on the latter.

A method for forming the contour shape of the displacer 5 and cylinder 4 which are main components of the displacement type compression element 1 of the present invention will now be explained in reference to FIGS. 4–6 (taking the example of using the three-threaded wrap). FIGS. 4(*a*) and 4(*b*) show an example shape of the displacer whose plan shape comprises a combination of arcs, FIG. 4(*a*) shows a plan view, and FIG. 4(*b*) shows a cross-sectional view. FIGS. 5(*a*) and 5(*b*) show an example cylinder shape paired and engaged with the displacer shown in FIGS. 4(*a*) and 4(*b*). FIG. 6 shows a part of the wall surface of the displacer shown in FIGS. 4(*a*) and 4(*b*) and a part of the cylinder shown in FIGS. 5(*a*) and 5(*b*), in which the center o of the former is overlaid on the center o' of the latter.

Figure 4A:
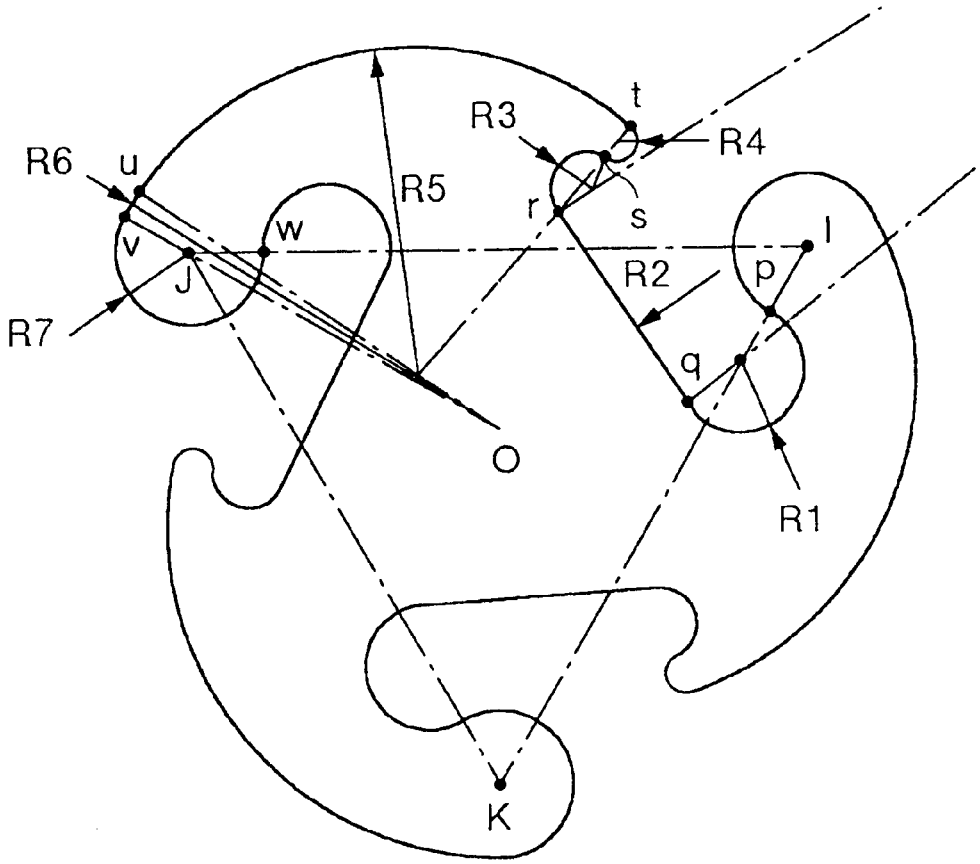
FIGS. 4 are views showing a construction of contours of the displacer of the displacement type fluid machine according to the present invention.
Figure 4B:
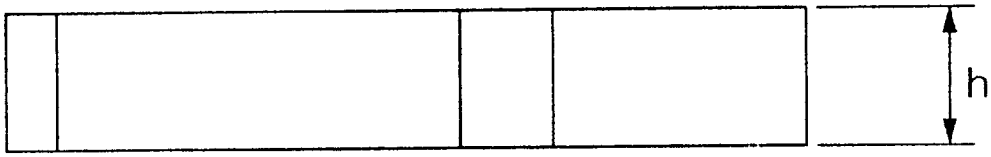

In FIG. 4A, the displacer is shaped so that three same contours are connected around the center o (the centroid of an equilateral triangle IJK). The contour shape is formed by seven arcs from a radius R1 to a radius R7, where points p, g, r, s, t, u, v and w are the connection points of the arcs having different radius, respectively. A curve pq is an arc having the radius R1 and the center on a side IK of an equilateral triangle, where the point p is at a distance R7 from an apex I. A curve qr is an arc having the radius R2 and the center on an extension of a straight line connecting the connection point q and the center of the radius R1. A curve rs is an arc having the radius R3 and the center on a straight line connecting the connection point r and the center of the radius R2. Similarly, a curve st is an arc having the radius R4 and the center on an extension of a straight line connecting the connection point s and the center of the radius R3. A curve tu is an arc having the radius R5 and the center on an extension of a straight line connecting the connection point t and the center of the radius R4. A curve uv is an arc having the radius R6 round the centroid o on an extension of a straight line connecting the connection point u and the center of the radius R5. A curve vw is an arc having the radius R7 round an apex J on a straight line connecting the connection point v and the center (the centroid o) of the radius R6. The angles of the arcs having the radii R1, R2, R3, R4, R5 and R6 are determined from the condition that the arcs are smoothly connected to one another at the connection points (the inclination angles of the tangent lines at the connection points are the same as one another). When the contour shape from the point p to the point w is rotated around the centroid o counterclockwise by 120°, the point p is put on the point w. The contour shape is further rotated by 120°, the whole contour shape is completed. A plan shape of the displacer is thereby obtained and the displacer is constructed by giving a thickness h.

After the plan shape of the displacer is determined, the contour shape of the cylinder, which is to engage with the displacer when the displacer gyrates with a gyration radius 6, is determined as an off-set curve at the outward normal distance ϵ from the curve of the contour shape of the displacer as shown in FIG. 6.

The contour shape of the cylinder will be explained with reference to FIGS. 5. The triangle IJK is the same equilateral triangle as that shown in FIGS. 4. The contour shape is constituted by seven arcs in all similarly to the displacer. Points p', q', r', s', t', u', v' and w' are the connection points of the arcs having different radii. A curve p'q' is an arc having the radius (R1−ϵ) and the center on a side IK of the equilateral triangle, where the point p' is at a distance (R7+ϵ) from an apex I. A curve q'r' is an arc having the radius (R2−ϵ) and the center on an extension of a straight line connecting the connection point q' and the center of the radius (R1−ϵ). A curve r's' is an arc having the radius (R3−ϵ) and the center on a straight line connecting the connection point r' and the center of the radius (R2−ϵ). Similarly, a curve s't' is an arc having the radius (R4+ϵ) and the center on an extension of a straight line connecting the connection point s' and the center of the radius (R3−ϵ). A curve t'u' is an arc having the radius (R5+ϵ) and the center on an extension of a straight line connecting the connection point t' and the center of the radius (R4+ϵ). A curve u'v' is an arc having the radius (R6+ϵ) round the centroid o' on an extension of a straight line connecting the connection point u' and the center of the radius (R5+ϵ). A curve v'w' is an arc having the radius (R7+ϵ) round an apex J on a straight line connecting the connection point v' and the center (the centroid o') of the radius (R6+ϵ). The angles of the arcs having the radii (R1−ϵ), (R2−ϵ), (R3−ϵ), (R4+ϵ), (R5+ϵ) and (R6+ϵ) are determined from the condition that the arcs are smoothly connected to one another at the connection points (the inclination angles of the tangent lines at the connection points are the same as one another), similarly to the displacer. When the contour shape from the point p' to the point w' is rotated around the centroid o' counter-clockwise by 120°, the point p' is put on the point w'. The contour shape is further rotated by 120°, the whole contour shape is completed. A plan shape of the cylinder is thereby obtained. The thickness H of the cylinder is a little larger than the thickness h of the displacer.

FIG. 6 shows the center o of the displacer shown in FIGS. 4 (FIG. 6 only shows a part of the displacer) overlaid on the center o' of the cylinder shown in FIGS. 5. The distance between the displacer and the cylinder is equal to the gyrating radius and is set to ϵ. Preferably, this distance is set to ϵ in the total periphery. However, within the range that the working chamber formed by the outer peripheral contour of the displacer and the inner peripheral contour of the cylinder is normally operated, it may be allowed that this relationship is not established for any reason.

The method for combining a plurality of arcs is explained as the method for constructing the contour shapes of the outer wall of the displacer and the inner wall of the cylinder, but the present invention is not limited to this method. It is possible to construct a similar contour shape by combining arbitrary curves (curves represented by n-degree expressions, and so on).

Figure 7:
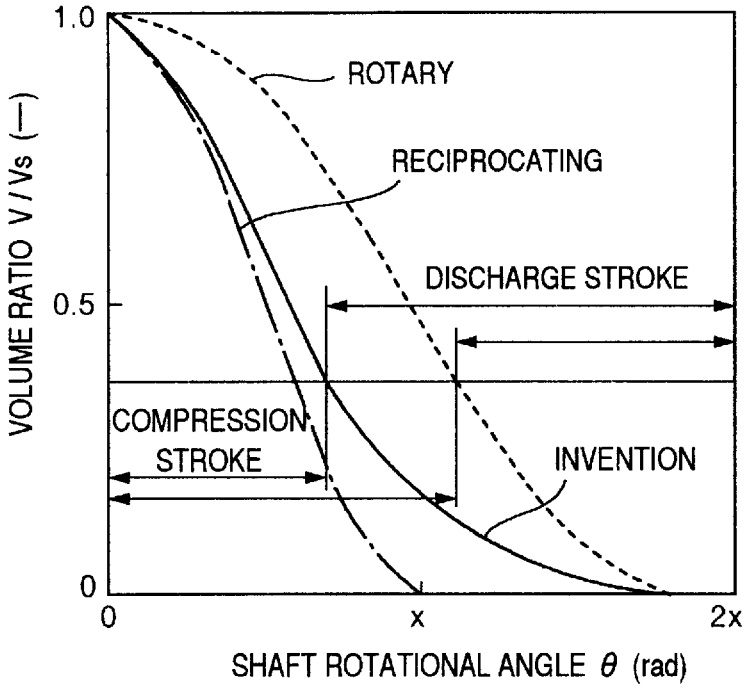
FIG. 7 is a view showing a characteristic of the displacement variation of a working chamber in the present invention.

The operation and effect of the embodiment having been explained with reference to FIGS. 1 to 6 will be explained below. FIG. 7 shows a characteristic of displacement variation of the working chamber according to the present invention (represented by the ratio of the suction displacement Vs to the working chamber displacement V) compared to another type of compressor by defining the rotational angle θ of the rotary shaft from the suction completion as a transversal axis. Thereby, the characteristic of displacement variation of the displacement type compression element 1 according to the embodiment is compared to the compressor in the condition of the air conditioner having the displacement ratio at the suction start of 0.37 (for example, in case that the working gas is HCFC 22, the suction pressure Ps=0.64 MPa, the discharge pressure=2.07 MPa). In this case, the compression process is substantially equal to the compression process of the recipro type. It is possible to reduce the leakage of the working gas and to enhance an ability and the efficiency of the compressor, since the compression process is completed. On the other hand, the discharge process is about 50% longer than the rotary type (the rolling piston type), since the flow velocity of the discharge gets more slowly, it is possible to reduce the pressure loss, further largely to reduce the fluid loss of the discharge process (over-compression loss) and to enhance the performance.

Figure 8:
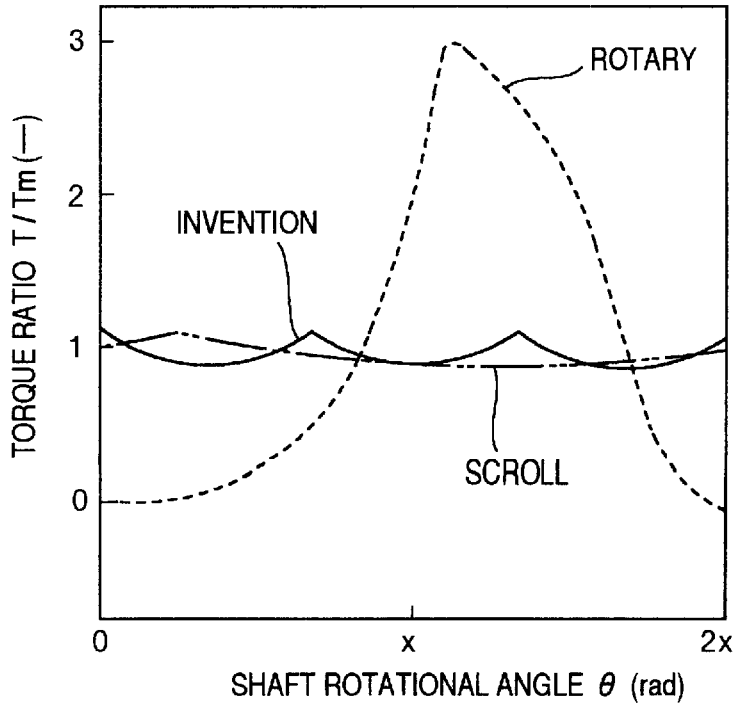
FIG. 8 is a view showing a variation of the gas compression torque in the present invention.

FIG. 8 shows a variation of a work amount during one rotation of the rotary shaft according to the embodiment, that is, the variation of a gas compression torque T is compared to that of another type compressor (where Tm is an average torque). Thereby, the torque variation of the displacement type compression element 1 according to the present invention is 1/10 of the rotary type, that is, the torque variation is very small and substantially equal to that of the scroll type. However, since the compressor according to the present invention does not have a mechanism for reciprocating in order to prevent the rotary scroll rotation such as an Oldam's ring of the scroll type, it is possible to balance the shaft system and to reduce the vibration and noise of the compressor. Also, since the compressor according to the present invention is not a long spiral shape such as the scroll type, it is possible to reduce a working time and a cost. Further, since there is not the end plate (a mirror plate) for holding the spiral shape, it is possible to prepare by the work similarly to the rotary type compared to the scroll type which can not work by passing the jig through. Further, since a thrust load due to a gas pressure is not applied to the displacer so that it is easy to manage the clearance in the direction of the shaft largely affecting the performance of the compressor in comparison with a scroll type compressor, it is possible to enhance the performance. Further, the thickness can be decreased in comparison with the scroll type compressor having the same volume and the same outside diameter as a result of calculation, and it is possible to downsize and lighten the compressor.

Next, the relationship between the above wrap angle θ and the rotational angle θc of the rotary shaft from the suction completion to the discharge completion will be explained. Although a case of the wrap angle of 360° has been explained in the above embodiment, by changing the wrap angle θ, it is possible to change the rotational angle θc of the rotary shaft. For example, since the wrap angle is 360° in FIGS. 2, the stroke condition comes back to the beginning by the rotational angle of 360° of the rotary shaft from the suction completion to the discharge completion. When the wrap angle is changed to less than the wrap angle of 360° so that the rotational angle θc of the rotary shaft from the suction completion to the discharge completion is changed to be small, the discharge port is linked through the suction port. Thereby, the fluid in the discharge port is expanded so that there is a problem that once sucked fluid is flowed back. The wrap angle is changed to more than 360° so that the rotational angle of the rotary shaft is changed to more than 360°, two working chambers, each having different size, respectively, are formed while the fluid is passed through the space of the suction port from the suction completion. Thereby, when the fluid machine is used as the compressor, each pressure in these two working chambers rises differently from each other. Accordingly, when these two working chambers join, since an irreversible mixture loss is occurred, the compression power is increased. Also, if attempting to use the fluid machine as a hydro pump, since the chamber which does not link through the discharge port is formed, the fluid machine can not be used as the pump. Thus, preferably, the wrap angle θ is 360° within the range of an allowed precision.

According to the fluid machine described in the above described Japanese Patent Publication No. 55-23358 (citation 1), the rotational angle θc of the rotary shaft of the compression process is set to θc=180°. According to the fluid machine described in the above-described Japanese Patent Publication No. 5-202869 (citation 3) and No. 6-280758 (citation 4), the rotational angle θc of the rotary shaft of the compression process is set to θc=210°. The period from the discharge completion of the working fluid to the next compression process start (the discharge completion) is the rotational angle θc of 180° of the rotary shaft according to the citation 1, and the rotational angle θc of 150° of the rotary shaft according to the citations 3 and 4.

Figure 9A:
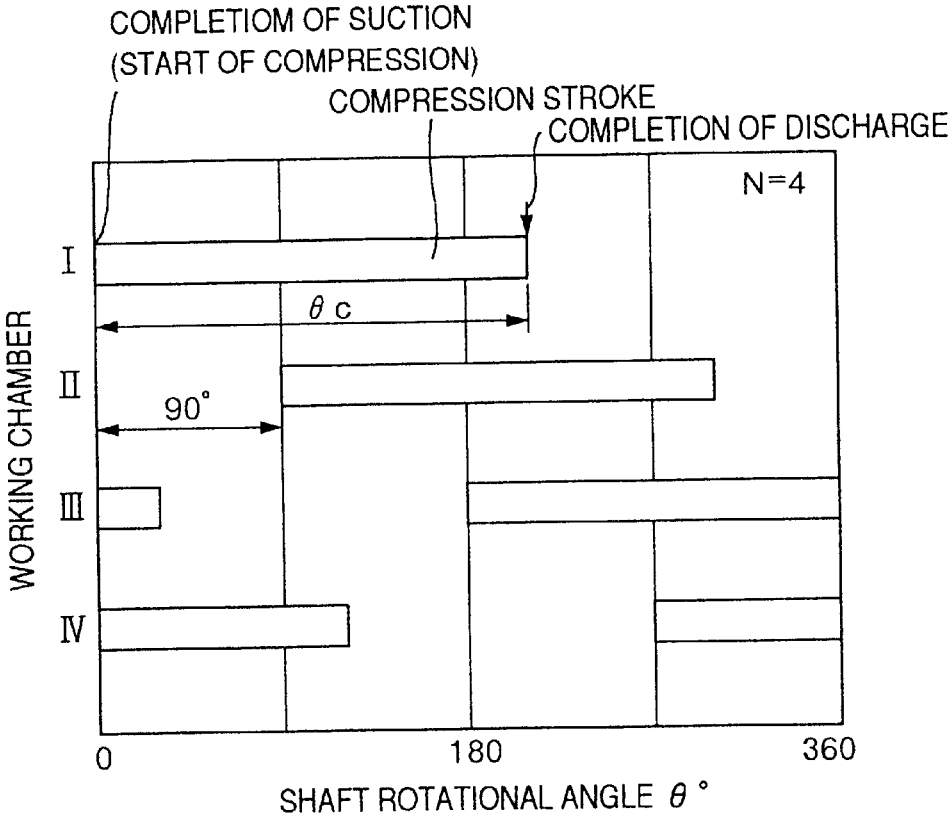
FIGS. 9 are views showing a relationship between the shaft angle and the working chamber in a case of four-threaded wrap.
Figure 9B:
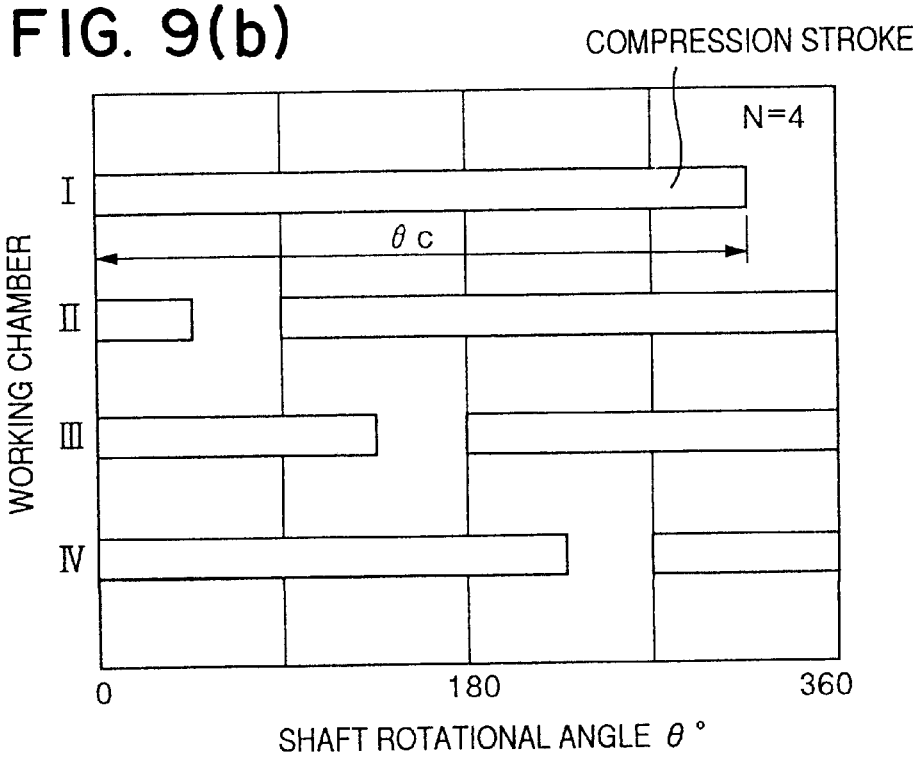

FIG. 9(*a*) shows the compression process of each working chamber (shown by references I, II, III, IV) during one rotation of the shaft in case that the rotational angle θc of the rotary shaft of the compression process is θc=210°. Where the number of threads N=4. Although four working chambers are formed within the range of the rotational angle θc of 360° of the rotary shaft, the number n of the simultaneously formed working chambers is n=2 or 3 in case of a particular angle. Accordingly, the maximum value of the number of the simultaneously formed working chambers is 3, that is, less than the number of threads.

Figure 10A:
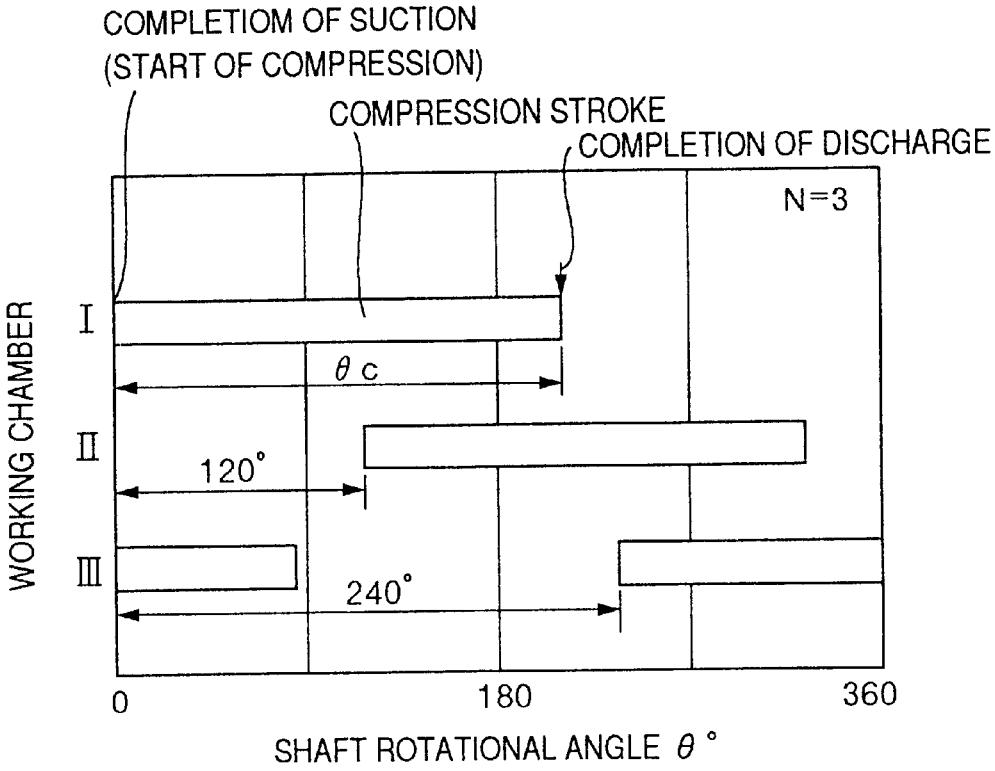
FIGS. 10 are views showing a relationship between the shaft angle and the working chamber in a case of three-threaded wrap.
Figure 10B:
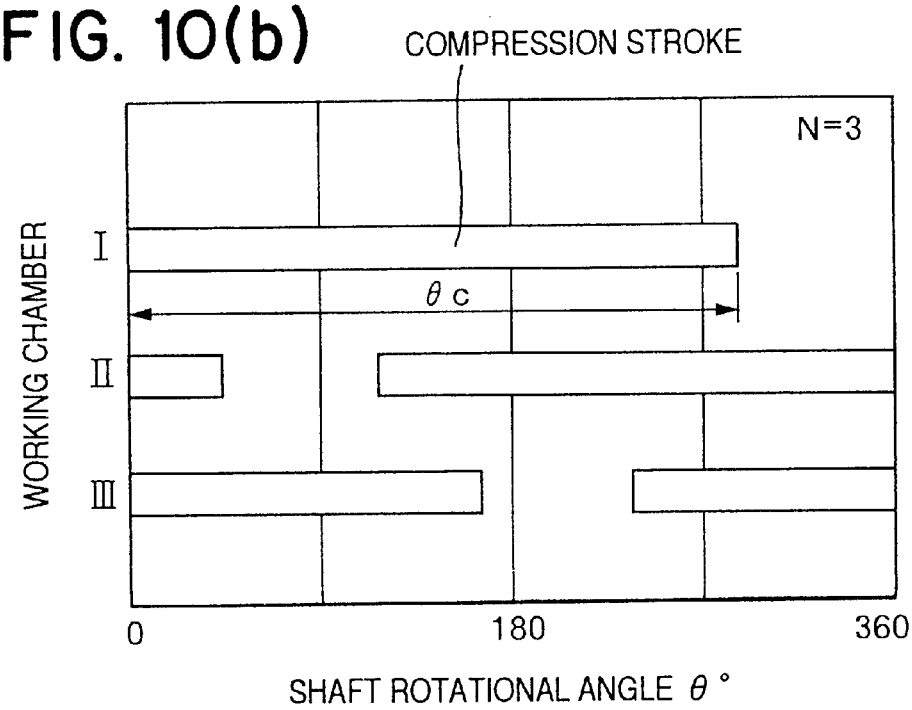

Similarly, FIGS. 10 show the number of the working chambers in case that the number of threads N=3 and the rotational angle θc of the rotary shaft of the compression process is θc=210°. In this case, the number of the simultaneously formed working chambers n is n−1 or n−2. Accordingly, the maximum value of the number of the simultaneously formed working chambers is 2, that is, less than the number of threads.

In the above case, since the working chambers are inclined to be formed around the rotary shaft, a dynamic unbalance is occurred. Thereby, the rotating moment acting on the displacer is excessively high so that a contact load between the displacer and the cylinder is increased. Accordingly, there are problems that the performance is reduced due to an increased machine friction loss and the reliability is reduced due to the abrasion of the vane.

For solving the above problem, the rotational angle θc of the rotary shaft from the completion of a stroke of suction to the completion of a stroke of discharge (This may be called "compression process") is satisfied with the following algorithm.

$$(((N-1)/N\cdot 360°)<\theta c\leqq 360° \qquad \text{(algorithm 1)}$$

Thereby, the outer peripheral contour shape of the displacer and the inner peripheral contour shape are formed. In other words, the above wrap angle θ is within the range given by the algorithm 1. Referring to FIG. 9(*b*), the rotational angle θc of the rotary shaft is more than 270°. The number n of the simultaneously formed working chambers is n=3 or 4 so that the maximum value of the working chambers is 4. This value corresponds to the number of threads N (=4). Also, in FIG. 10(*b*), the rotational angle θc of the rotary shaft of the compression process is more than 240°. Accordingly, the number n of the simultaneously formed working chambers is n=2 or 3 so that the maximum value of the working chambers is 3. This value corresponds to the number of threads N (=3).

In this manner, the lowest value of the rotational angle θc of the rotary shaft of the compression process is more than the value given by the left side of the algorithm 1 so that the maximum value of the number of working chambers is more than the number of threads N. Thereby, the working chambers can be dispersed and located around the drive shaft so that it is possible to be dynamically balanced. Accordingly, it is possible to reduce the rotating moment acting on the displacer, to reduce the contact load between the displacer and the cylinder. Thereby, it is possible to enhance the performance because of the machine friction loss and further the reliability of the contact portion.

On the other hand, the upper value of the rotational angle θc of the rotary shaft of the compression process is 360° according to the algorithm 1. Ideally, the upper value of the rotational angle θc of the rotary shaft of the compression process is 360°. As described above, the time lag from the discharge completion of the working fluid to the next compression process start (the suction completion) can be 0. It is possible to prevent from reducing the suction efficiency due to a gas re-expansion in a spaced displacement occurred in case of θc<360°. Further, it is possible to prevent from the irreversible mixture loss due to each of different pressure risen in the two chambers in joining these chambers in case of θc>360°. The latter case will be explained in reference to FIGS. 11.

Figure 11A:
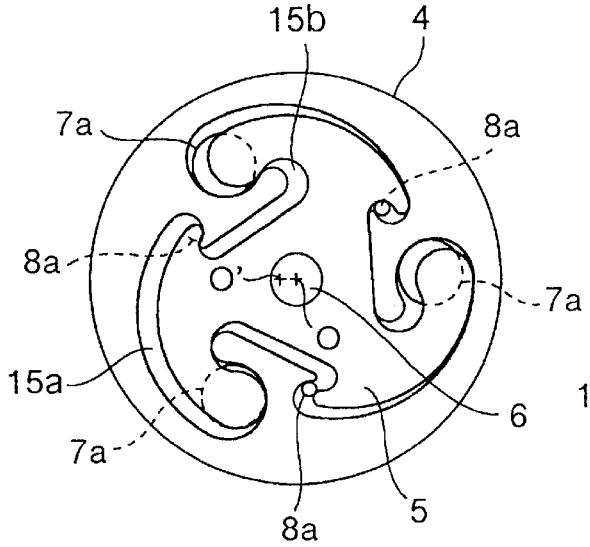
FIGS. 11 are views for explaining the operation in case that the wrap angle of the compression element is more than 360°.
Figure 11B:
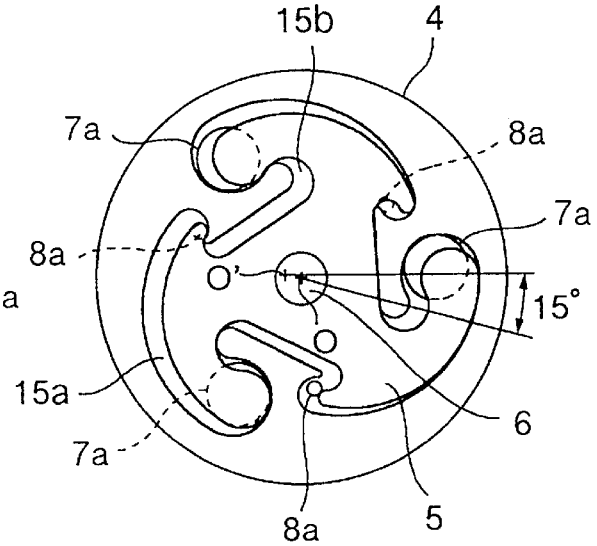
Figure 11C:
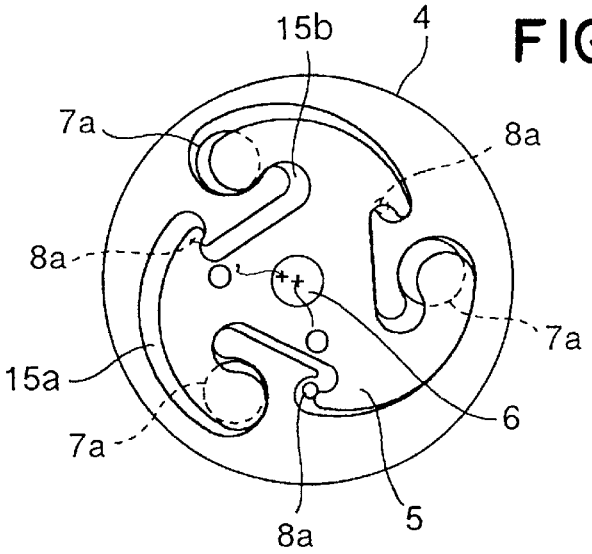

The rotational angle θc of the rotary shaft of the compression process of the displacement type fluid machine shown in FIGS. 11 is 375°. FIG. 11(*a*) shows the suction completion in two working chambers 15*a* and 15*b* in FIG. 11(*a*). At this time, the pressures in both of working chambers 15*a* and 15*b* are equal and the suction pressure Ps. The discharge port 8*a* is located between two working chambers 15*a* and 15*b*, and is not linked through both of the chambers. FIG. 11(*b*) shows that the rotational angle θc of the rotary shaft is rotated in 15° from the state shown in FIG. 11(*a*). FIG. 11(*b*) shows the state immediately before the working chambers 15*a* and 15*b* are linked through each other. At this time, the displacement of the working chamber 15*a* is less than the displacement in the suction completion shown in FIG. 11(*a*), the compression proceeds, and the pressure is higher than the suction pressure Ps. On the contrary, the displacement of the working chamber 15*b* is more than the displacement in the suction completion, and the pressure is lower than the suction pressure Ps due to the expansion. Next, the instant the working chambers 15*a* and 15*b* are combined with (linked through) each other, the irreversible mixture occurs as shown by an arrow in FIG. 11(*c*). Thereby, the pressure power is increased so that the performance is reduced. Accordingly, preferably, the upper limitation of the rotational angle θc of the rotary shaft of the compression process is 360°.

Figure 12A:
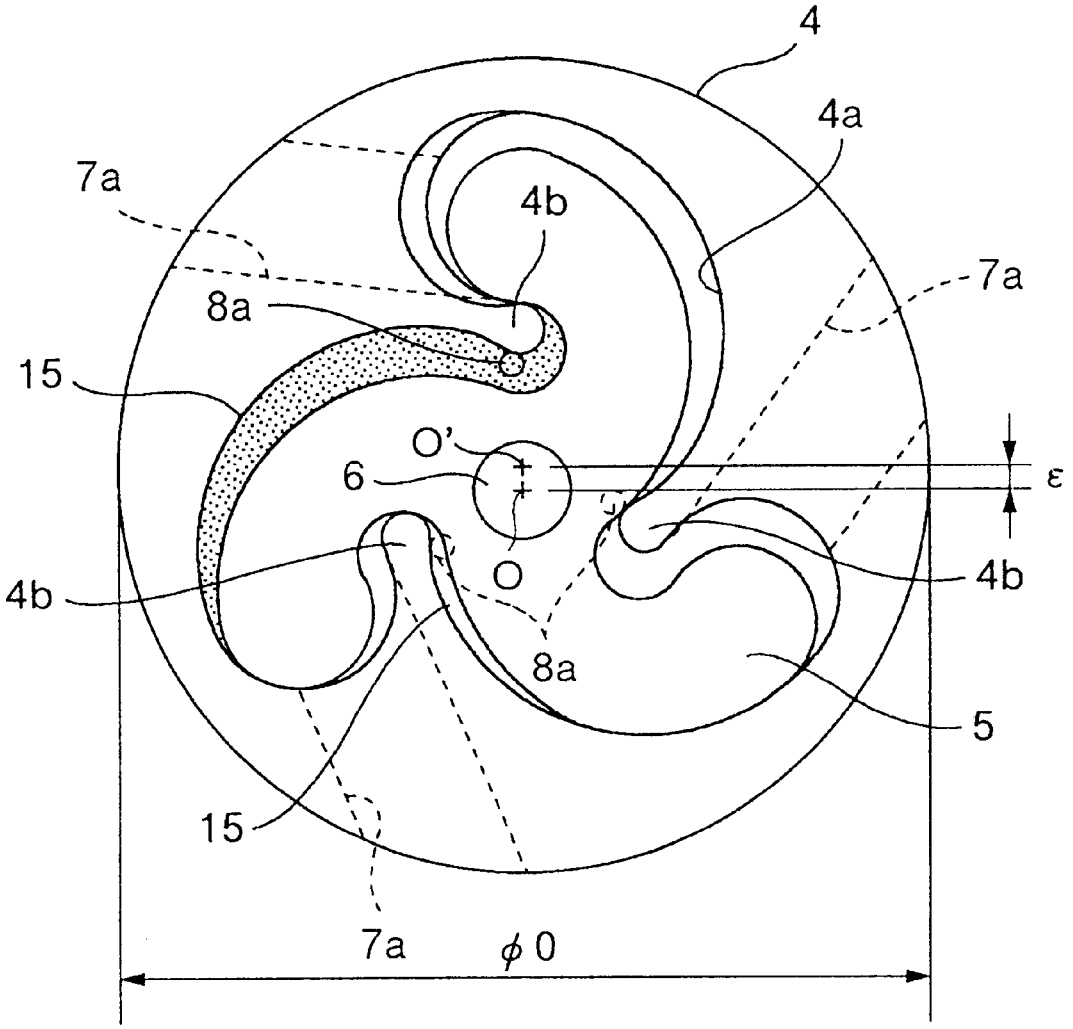
FIGS. 12 are views for explaining an enlargement of the wrap angle of the compression element.
Figure 12B:
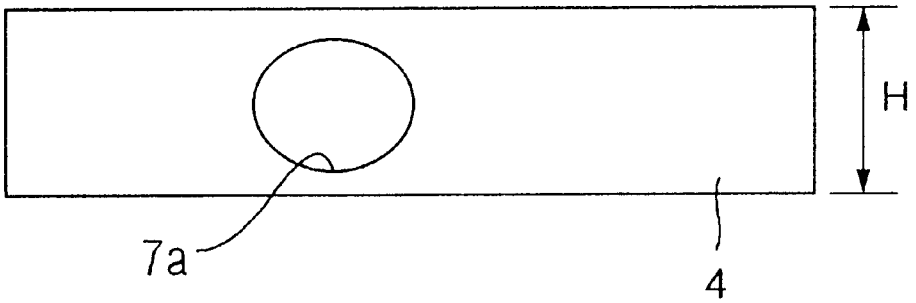

FIGS. 12 show the compression element of the rotary type fluid machine described in the citations 3 and 4. FIG. 12(*a*) shows a plan view and FIG. 12(*b*) shows a side view. The number of threads N is 3, and the rotational angle θc of the rotary shaft of the compression process is 210°. In FIGS. 12, the number n of the working chambers is n=1 or 2 as shown in FIG. 10(*a*). FIGS. 12 show that the rotational angle θc of the rotary shaft is 0°, and the number n of the working chambers is 2. As be apparent in FIGS. 12, the right space of the spaces formed by the outer peripheral contour shape of the displacer and the inner peripheral contour shape of the cylinder is not the working chamber, and the suction port 7*a* and the discharge port 8*a* are linked through each other. Thus, the gas in the spaced displacement of the discharge port 8*a* is re-expanded so that the gas flowed into the cylinder 4 from the suction port 7*a* is flowed back, thereby there is the problem that the suction efficiency is reduced.

By the way, the rotational angle θc of the rotary shaft of the compression process of the displacement type fluid machine shown in FIGS. 12 will be extended by considering the embodiment. In order to extend the rotational angle θc of the rotary shaft of the compression process, the wrap angle of the contour curve of the cylinder 4 must be larger as shown by a double-dot line. Thereby, the thickness of the vane 4*b* is excessively thin as shown in FIGS. 12. Accordingly, it is difficult that the rotational angle θc of the rotary shaft of the compression process is changed to be more than 240° in order that the maximum value of the number n of the working chambers is more than the number of threads N (N=3).

Figure 13A:
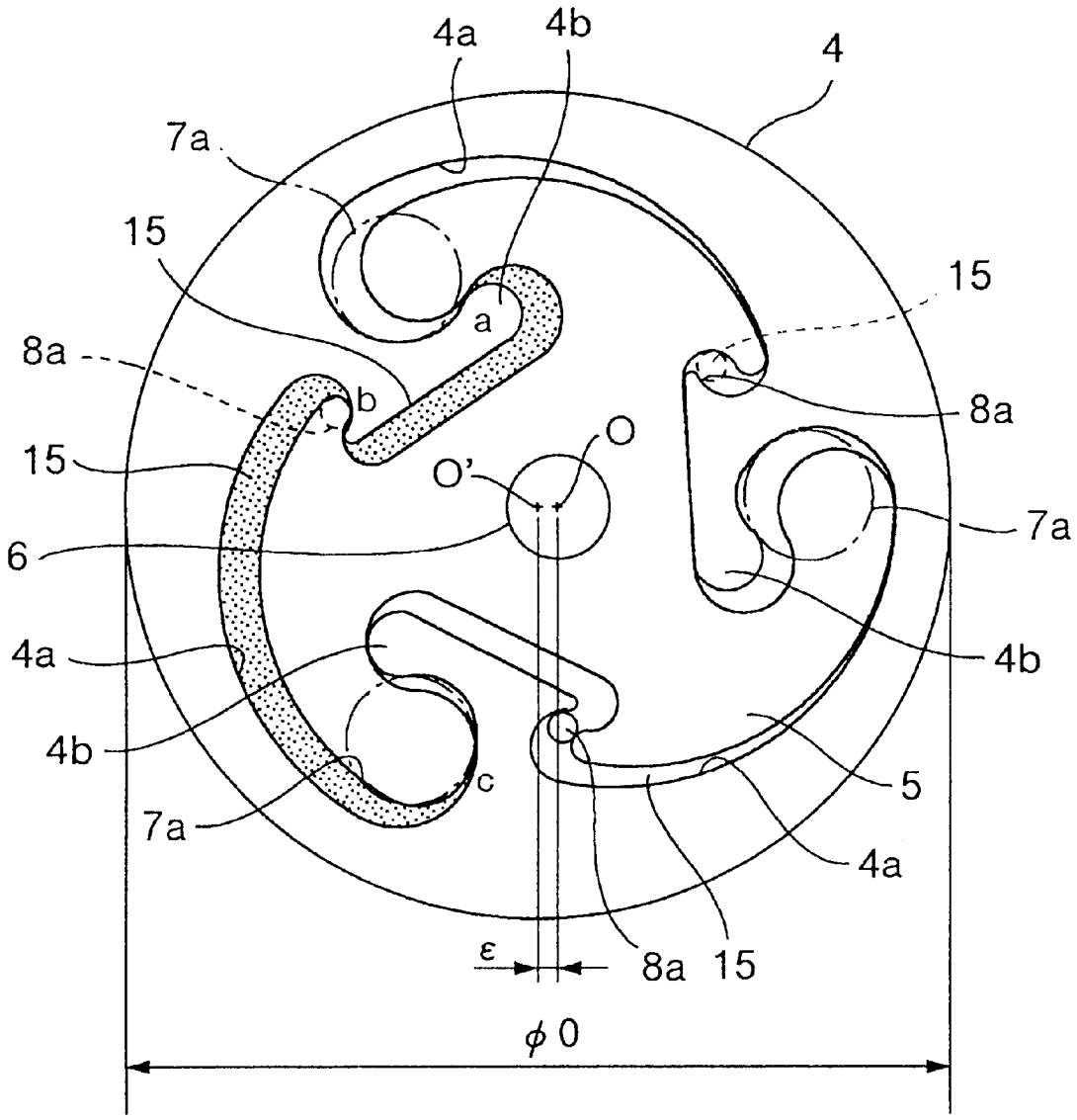
FIGS. 13 are views showing a modification of the displacement type fluid machine shown in FIG. 1.
Figure 13B:
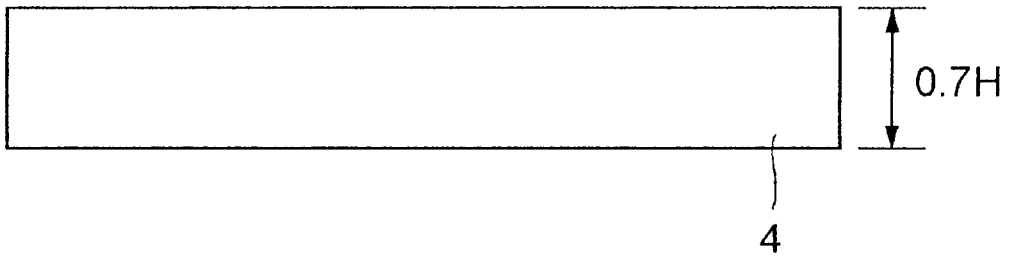

FIGS. 13 show the embodiment of the compression element of the displacement type fluid machine having the same process displacement (the suction displacement), the same outer diameter and the same rotary radium as those of the displacement type fluid machine shown in FIGS. 12. The rotational angle θc of the rotary shaft of the compression process of the compression element shown in FIGS. 13 can be 360°, that is, more than 240°. Since the compression element shown in FIGS. 12 comprises the smooth curves between sealing points which form the working chambers, even if the rotational angle θc of the rotary shaft of the compression process is attempted to be enlarged according to the embodiment, the maximum value of the rotational angle θc of the rotary shaft is at most 240°. However, since the compression element according to the embodiment shown in FIGS. 13 does not have the smooth curves between the sealing points (the point a to the point c) (that is, does not have the similar curve), the shape near the point b is extruded relative to the displacer. Further, the narrow portion exists on the way from the center portion to the end portion of each thread. This can be also described according to the embodiment shown in FIGS. 1. Due to these shapes, the wrap angle θ from the engaging point a to the engaging point b can be 360°, that is, can be more than 240°. Further, the wrap angle θ from the engaging point b to the engaging point c can be 360°, that is, can be more than 240°. Consequently, the rotational angle θc of the rotary shaft of the compression process can be 360° more than 240° so that the maximum value of the number n of the working chambers can be more than the number of threads N. Thus, it is possible to disperse the working chambers so that the rotating moment can be reduced.

Further, since the number of the working chambers which functions effectively is increased, when the height (thickness) of the cylinder of the compression element shown in FIGS. 12 is set to H, the height of the cylinder of the compression element shown in FIGS. 13 is 0.7H and is 30% lower than that in FIGS. 12. Accordingly, it is possible to downsize the compression element.

Figure 14:
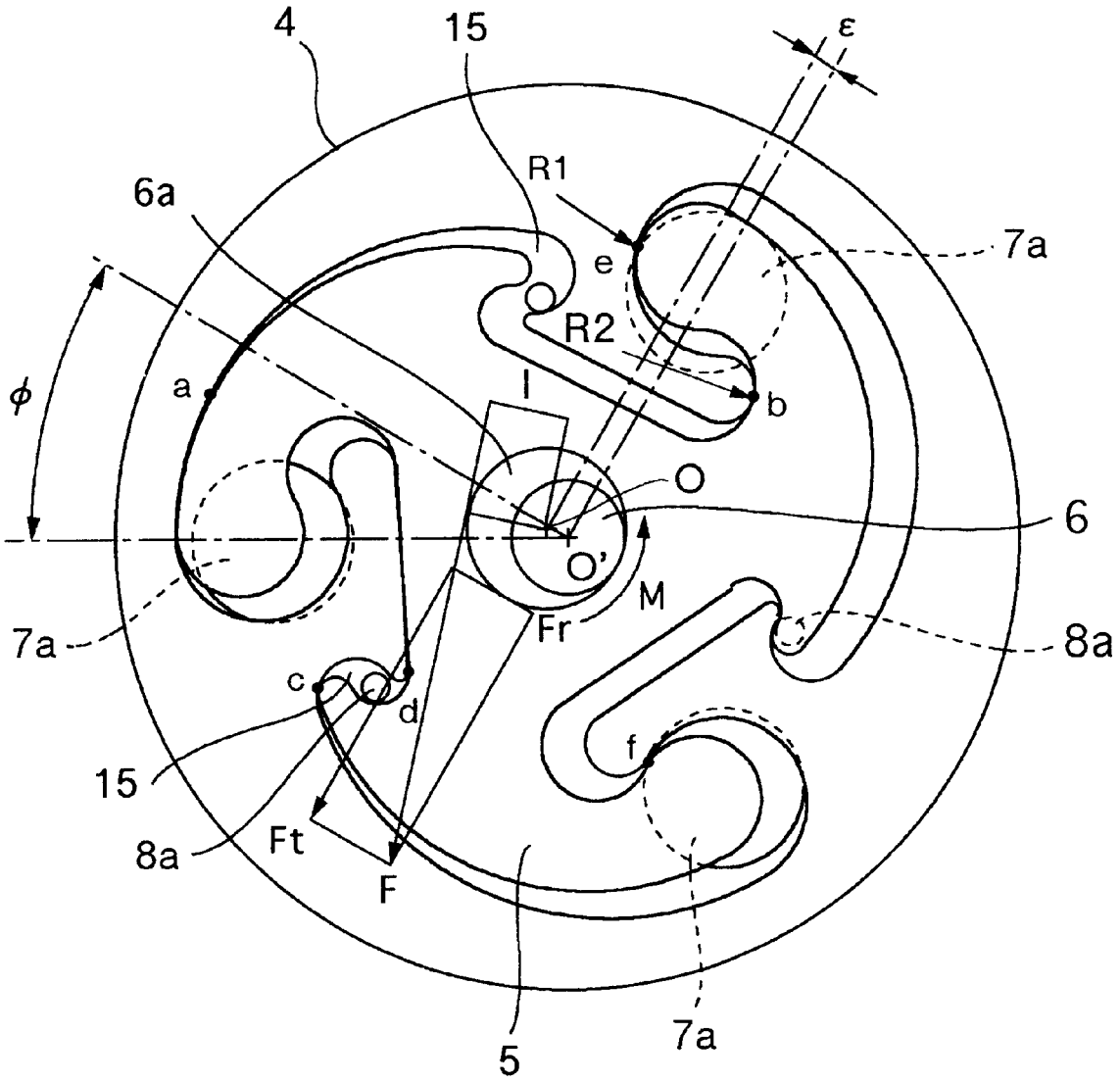
FIG. 14 is a view for explaining a load and a moment applied to the displacer of the present invention.

FIG. 14 shows the load and the moment applied to the displacer 5 according to the embodiment. A reference θ denotes the rotational angle of the rotary shaft 6, and a reference ϵ denotes the rotary radius. By an internal pressure in each working chamber 15 accompanied with the working gas compression, a force Ft in the direction of the tangent line perpendicularly to the direction of an eccentricity and a force Fr in the direction of the radius corresponding to the direction of the eccentricity are applied to the displacer 5. A resultant force of Ft and Fr is F. This resultant force F is shifted relative to the center o of the displacer 5 (a length of an arm is 1) so that a rotating moment M acts in order to rotate the displacer. This rotating moment M is supported by a reaction force R1 and a reaction force R2 at the engaging points g and b. According to the present invention, the moment is applied at two or three engaging points near the suction port 7*a,* and the reaction force does not act at other engaging points. In the displacement type compression element 1 according to the present invention, the working chambers are dispersed and located around the crank portion 6*a* of the rotary shaft 6 engaged with the center portion of the displacer 5 at substantially equal pitch so that the rotational angle of the rotary shaft from the suction completion to the discharge completion is substantially 360°. Accordingly, an action point of the resultant force F can be approached to the center o of the displacer 5 so that it is possible to reduce the length of the arm 1 of the moment and to reduce the rotating moment M. Accordingly, it is possible to reduce the reaction forces R1 and R2. Also, as understood by the locations of the engaging points g and b, since sleeve parts of the displacer 5 and the cylinder 4 applied by the rotating moment M is near the suction port 7*a* for the working gas having a low temperature and a high oil viscosity, an oil film can be ensured so that it is possible to provide the more reliable displacement type compressor for solving the problem of the friction and the abrasion.

Figure 15:
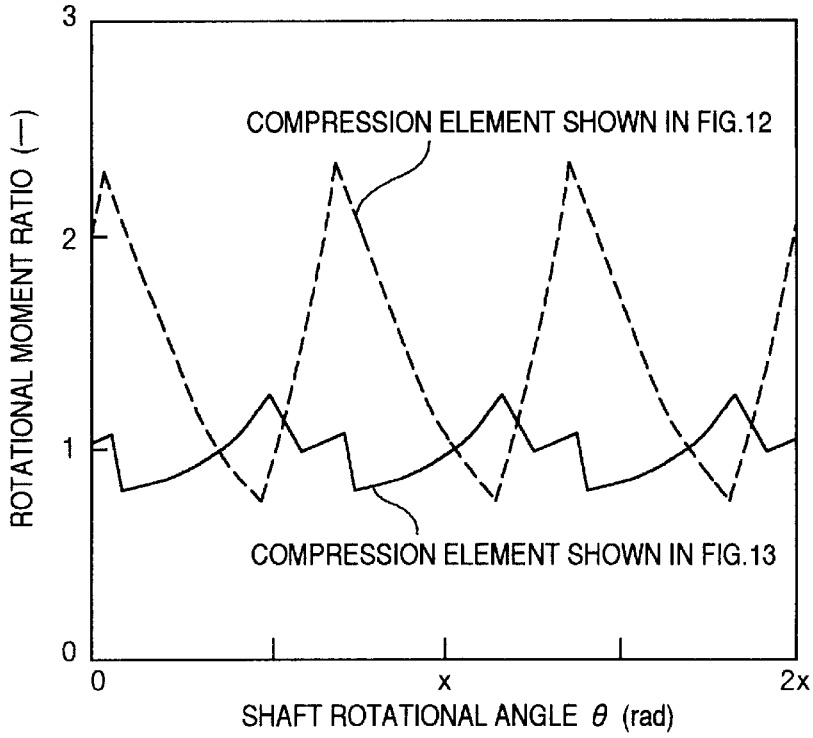
FIG. 15 is a view showing a relationship between the shaft angle of the compression element and a rotating moment ratio.

FIG. 15 shows that the rotating moment M during one rotation of the shaft acting on the displacer by the internal pressure of the working fluid is compared to the compression elements shown in FIGS. 12 and 13. A calculation condition is a refrigeration condition of the working fluid HFC134a (where the suction pressure Ps=0.095 Mpa and the discharge pressure Pd=1.043 Mpa). Thereby, according to the compression element of the embodiment having the maximum value of the working chambers N more than the number of threads, since the working chambers from the suction completion to the discharge completion are dispersed and located around the rotary shaft at substantially equal pitch, it is possible to be dynamically balanced so that the load vector by the compression can be pointed toward the substantial center. Thus, it is possible to reduce the rotating moment M acting on the displacer. Consequently, it is possible to reduce the contact load of the displacer and the cylinder, to enhance the machine efficiency and further to enhance the reliability as the compressor.

The relationship between the period that the suction port 7*a* is linked through the discharge port 8*a* and the rotational angle of the rotary shaft of the compression process will be now explained. The period that the suction port 7*a* is linked through the discharge port 8*a,* that is, the time lag Δθ represented by the rotational angle of the rotary shaft during the period from the discharge completion of the working fluid to the next compression start (the suction completion) is represented by Δθ=360°−θc as the rotational angle θc of the rotary shaft of the compression process.

In case of $\Delta\theta \leqq 0°$, since the period that the suction port is linked through the discharge port does not exist, the suction efficiency is not reduced due to the re-expansion of the gas in the spaced displacement of the discharge port.

In case of $\Delta\theta \leqq 0°$, since the period that the suction port is linked through the discharge port exists, the suction efficiency is reduced due to the re-expansion of the gas in the spaced displacement of the discharge port. Thereby, the refrigeration ability of the compressor is reduced. Also, due to the reduction of the suction efficiency (the volume efficiency), the adiabatic efficiency, that is, the energy efficiency of the compressor, or the result coefficient is also reduced.

The rotational angle θc of the rotary shaft of the compression process is determined by the wrap angle θ of the contour curve of the displacer or the cylinder and the locations of the suction port and the discharge port. In case that the wrap angle of the contour curve of the displacer or the cylinder is 360°, the rotational angle θc of the rotary shaft of the compression process can be 360°. Further, the sealing point of the suction port or the discharge port is moved so that $\Delta\theta<360°$ may be set. However, $\Delta\theta>360°$ can not be set. For example, the location and size of the discharge port is changed so that it is possible to change the rotational angle θc=375° of the rotary shaft of the compression process of the compression element shown in FIGS. 11 into the rotational angle θc=360° of the rotary shaft. Immediately after the suction completion in FIGS. 11, the discharge port is enlarged so that the working chamber 15*a* can be linked through the working chamber 15*b* in order to change the shaft angle θc=375° into θc=360°. By this change, it is possible to reduce the irreversible mixture loss due to the differently rising pressures in the two working chambers occurred when the shaft angle is θc=375°. Accordingly, the wrap angle of the contour curve is a necessary condition, but a sufficient condition for determining the rotational angle θc of the rotary shaft of the compression process.

According to the above described embodiment, that is, the embodiment shown in FIG. 3, the sealing type compressor of a low pressure in the sealing container 3 (suction pressure) type is described above. The low pressure type compressor has the following advantages:

(1) Since the motor element 2 is less heated by the compressed working gas having a high temperature, because of being cooled by the sucked gas, the temperature of the stator 2*a* and the rotor 2*b* is fallen down so that the motor efficiency can be enhanced in order to enhance the performance.

(2) In the working fluid which is soluble in the lubricating oil 12 such as CFCs, etc., since the pressure is low, the ratio of the working gas melted in the lubricating oil 12 is less. Accordingly, the oil is less effervesced by the bearing, etc. so that it is possible to enhance the reliability.

(3) A pressure tightness in the sealing container 3 can be lower so that it is possible to slim and lighten the compressor.

Figure 16:
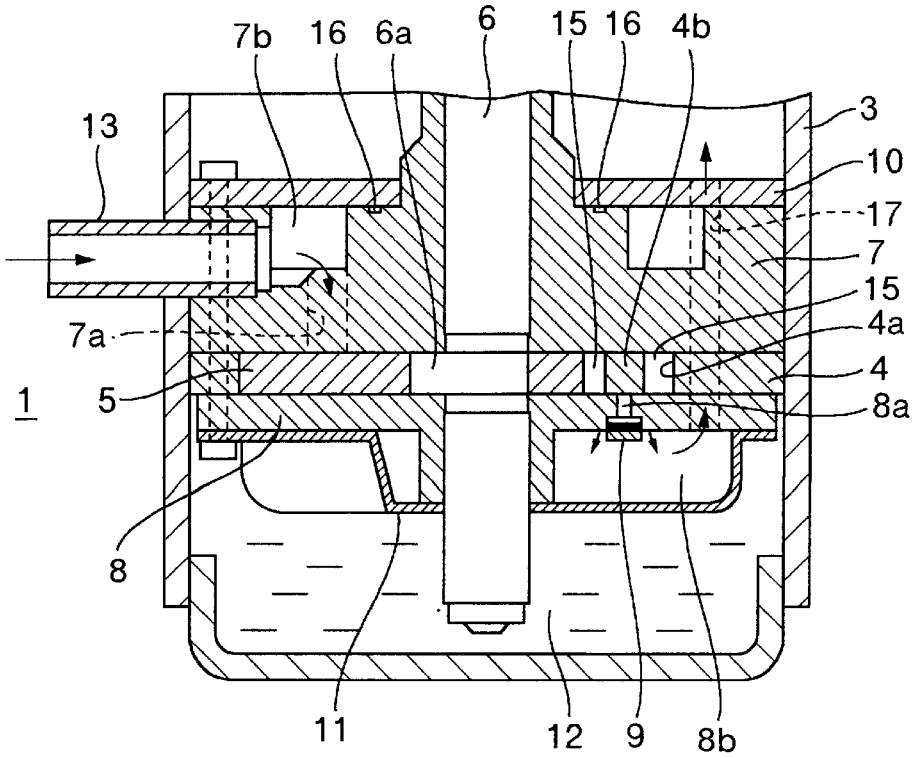
FIG. 16 is a vertical sectional view of the principal part of a sealed-type compressor according to another embodiment of the present invention.

Next, the sealing container 3 (discharge pressure) type compressor kept at a high pressure will be explained. FIG. 16 shows a partially enlarged sectional view of the sealing type compressor of the high pressure type in case that the displacement type fluid machine of another embodiment according to the present invention is used as the compressor. In FIG. 16, the elements having the same reference numbers in FIGS. 1–3 are the same portions and have the same action in FIG. 16. In FIG. 16, a numeral 7*b* denotes a suction chamber integrated with the main bearing member 7 by the suction cover 10. The suction chamber 7*b* is divided from the pressure (the suction pressure) in the sealing container 3 by the sealing member 16, etc.. A numeral 17 denotes a discharge path through into the discharge chamber 8*b* and the sealing container 3. The principle of the work etc. of the displacement type compression element 1 is similar to that of the low pressure type (suction pressure) type.

As the flow of the working gas shown by an arrow in FIG. 16, the working gas passes through the suction pipe 13, enters into the suction chamber 7*b*, passes through the suction port 7*a* formed in the main bearing member 7, and enters into the displacement type compression element 1, where the rotary shaft 6 is rotated so that the piston 5 is gyrated. Thereby, the displacement of the working chamber 15 is reduced in order to compress the working gas. The compressed working gas passes through the discharge port 8*a* formed on the end plate of the auxiliary bearing member 8, pushes up the discharge valve 9, enters into the discharge chamber 8*b*, passes through the discharge path 17, enters into the sealing container 3, and flows outwardly from the discharge pipe (not shown) connected to the sealing container 3.

Since the lubricating oil 12 is highly pressured, the rotary shaft 6 is rotated so that a centrifugal pump etc. is operated in order to feed the lubricating oil 12 with each bearing sleeve portion, the fed lubricating oil 12 is passed through the space between the end surface of the displacer 5 so that it is easy to provide the lubricating oil 12 into the cylinder 4. Accordingly, it is possible to enhance the sealing ability of the working chamber 15 and the lubricating ability of the sleeve portion.

In the compressor using the rotary type fluid machine of the present invention, it is possible to select either the low pressure type or the high pressure type according to a specification, an application of an equipment or a manufacturing facility. Thereby, it is possible flexibly to design.

By the way, it was found that the whole adiabatic efficiency lowers in a relatively high rotational speed range when a displacement type fluid machine in which a displacer and a cylinder are located between end plates, a space is formed by an inner wall surface of said cylinder and an outer wall surface of said displacer when the center of said displacer is located on the center of said cylinder, and a plurality of spaces is formed when the positional relationship between said displacer and said cylinder is for a gyration, as described above, is operated as a compressor.

The wall surface of the vane 4*b* protruding inwardly of the cylinder 4 is a constituent of the working chamber in case of operating as a compressor. For example, as shown in the working chamber 15 of FIG. 2(2), this working chamber 15 is in compressing a coolant. The pressure in the space communicating with the suction port 7*a* around the vane 4*b* of the working chamber 15 is a suction pressure. At this time, the end plates 7 and 8 are deformed to expand due to the pressure of the working chamber. The vane 4*b* thus becomes free without restraining both end surfaces. That is, the vane 4*b* becomes in a state of a beam one end of which is fixed and the other end of which is free. The vane 4*b* is thus deformed in the direction that the pressure is lower. If there is formed any gap in the sealing point at this time, the coolant moves in the direction of the lower pressure through the gap. As a result, the whole adiabatic efficiency lowers.

Furthermore, because the vane 4*b* is in the state of the beam one end of which is fixed and the other end of which is free, a stress concentration occurs near the base of the vane 4*b* when it is pressed by external force such as differential pressure. This causes another problem that the safety factor in strength lowers.

Figure 17:
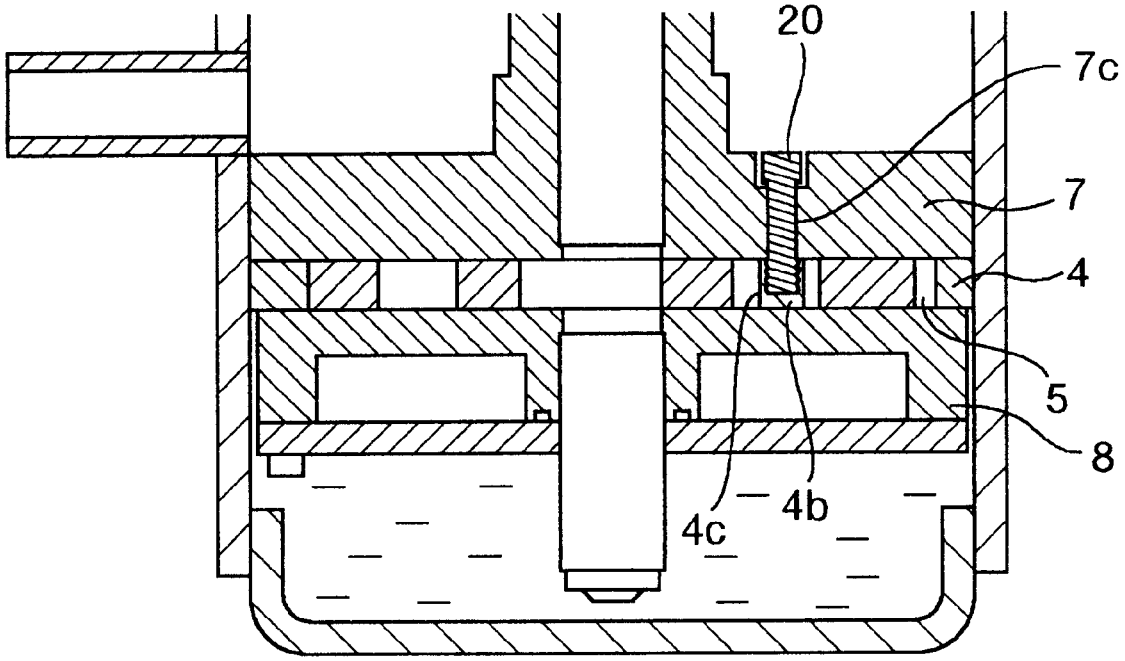
FIG. 17 is a view for explaining an embodiment in which a vane according to the present invention is fixed to an end plate.

An embodiment for solving such problems will be described with reference to FIG. 17. FIG. 17 corresponds to the AA' cross section in FIG. 1(*b*). For solving the above problems, at least one end plate 7 and the tip portion of the vane 4*b* are fixed to each other in this embodiment. That is, in FIG. 17, a screw hole 4*c* not bored through is formed in the tip portion of the vane 4*b*. A through hole 7*c* (including a larger-diameter part than the other part of the through hole 7*c* for receiving a screw head) is formed in a portion of the end plate 7 opposed to the tip portion of the vane 4*b*. Both members are fixed to each other with a screw 20 the tip portion of which is threaded.

In this manner, the vane 4*b* is in a state of fixture not through one end but through at least two surfaces. It can thus have a sufficient strength against a gas which generates in each stroke of compression. Because its deformation quantity can be suppressed to the minimum even in case of the discharge pressure to the extent of about 2 Mp, there is an effect that the deterioration of the whole adiabatic efficiency due to the deformation can be restrained.

In the above literature 4, there is a description that through holes are formed in both end plates and the displacer to clamp them with screws. The screw clamp is for holding both of the end plates as near to the center as possible. That is, both of the end plates are clamped with screws at their end portions. But at the central portion, any screw clamp with a through hole is impossible because there is a shaft and the neighborhood is the domain of the movement of the displacer. For this reason, a screw clamp is performed by forming a through hole in the tip portion of the vane because it is the portion as near to the center as possible in the stationary member.

If this idea is employed as it is, however, first a problem in assembling performance, second a problem of clearance management between both of the end plates and the displacer arise. When a gyration type fluid machine is assembled, it must be assembled to obtain a positional relationship that the sealing point between the displacer and cylinder smoothly moves following the gyration of the displacer. In this assembling work, relative positions of both are determined with minute rotations of the cylinder. If the end plates are clamped as described in the literature 4, this work can not be performed. In this embodiment, because at least one end plate and the tip portion of the vane are fixed to each other, one end portion is opened and positioning can easily be performed. After positioning, the other end plate and the tip portion of the vane may be fixed by a method such as adhesion. Further, if both of the end plates sandwich the tip portion of the vane and they are fixed with a screw, the strength of the vane increases because the vane is in sufficient contact with the end plates. But if they are clamped too strongly, the displacer gyrates under a condition that it is in excessive contact with the end plates. This causes a seizure and a problem that the efficiency lowers because of increase of motor input. Contrarily, if the clamp is too loose, the degree of freedom of the vane movement increases by the degree that the inside diameter of the screw hole formed in the vane is larger than the diameter of a screw (bolt) for allowing it to enter. In this case, there is a problem that a movement of the coolant occurs upon deformation of the vane and the whole adiabatic efficiency lowers. According to this embodiment, there is an effect that both of the above problems are solved at once.

Figure 18A:
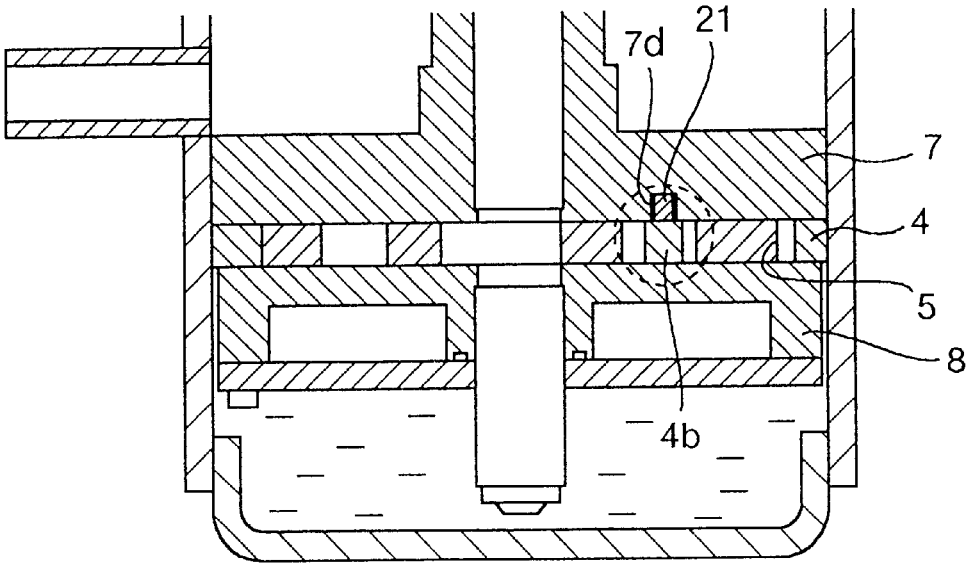
FIGS. 18 are views for explaining an embodiment in which a vane according to the present invention is fixed to an end plate.
Figure 18B:
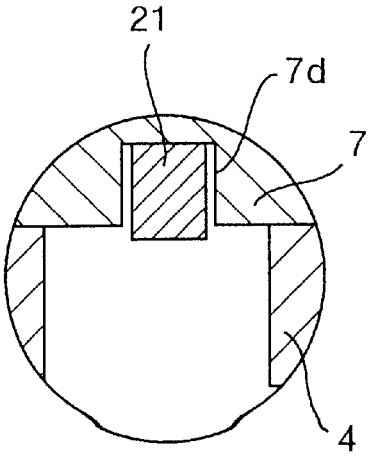
Figure 18C:
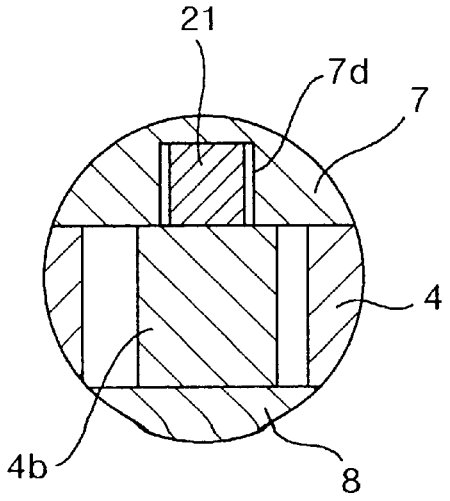

In the above embodiment, there is a problem that it is necessary to form the thread in the tip portion of the vane 4*b* to increase the number of steps and a screw as a separate part is needful. An embodiment which solved this problem will be described with reference to FIG. 18(*a*). A groove 7*d* which is narrower than the tip shape of the vane 4*b* and along the tip shape is formed in the end plate 7 at the position opposite to the tip portion of the vane 4*b*. An elastic restraining part 21 such as a heat-resisting resin is inserted in the groove 7*d* and screw clamps are performed on the periphery of the cylinder. As shown in FIG. 18(*b*), the size of the restraining part 21 is selected so that the restraining part 21 slightly protrudes from the end surface of the groove 7*d* before assembling.

Also in this embodiment, there is an effect that the deformation of the vane can be restrained without deteriorating the assembling performance while the clearance management can easily be performed.

Figure 19:
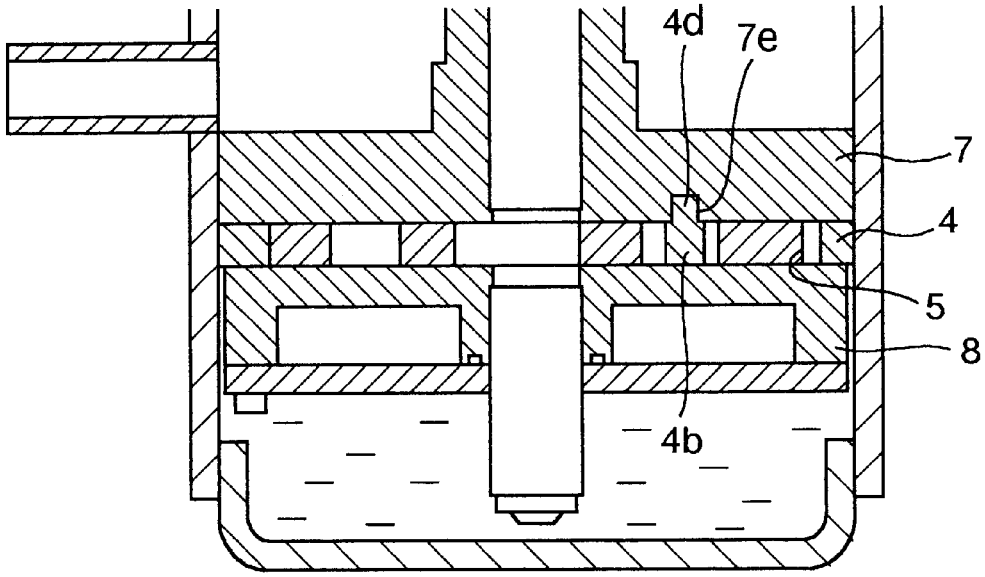
FIG. 19 is a view for explaining an embodiment in which a vane according to the present invention is fixed to an end plate.

Although the restraining part as a separate part is needful in the above embodiment shown in FIGS. 8, an embodiment which has no need of such a separate part will be described with reference to FIG. 19. A convex portion 4*d* extending in the axial direction is formed on the tip end surface of the vane 4*b* and a concave portion 7*e* in which the convex portion 4*d* is fitted is formed in the end plate 7 at the position opposite to the convex portion 4*d*. The shape of the concave portion 4*d* may be rectangular or cylindrical and can be selected to meet the workability. As a matter of course, the shape of the concave portion 7*e* formed in the end plate 7 must correspond to the shape of the convex portion 4*d*. Besides, the relationship between the convex and concave may be inverted. According to this embodiment, there is an effect that the tip portion of the vane can be fixed without using a separate part in addition to the effect described in the above embodiment.

Figure 20:
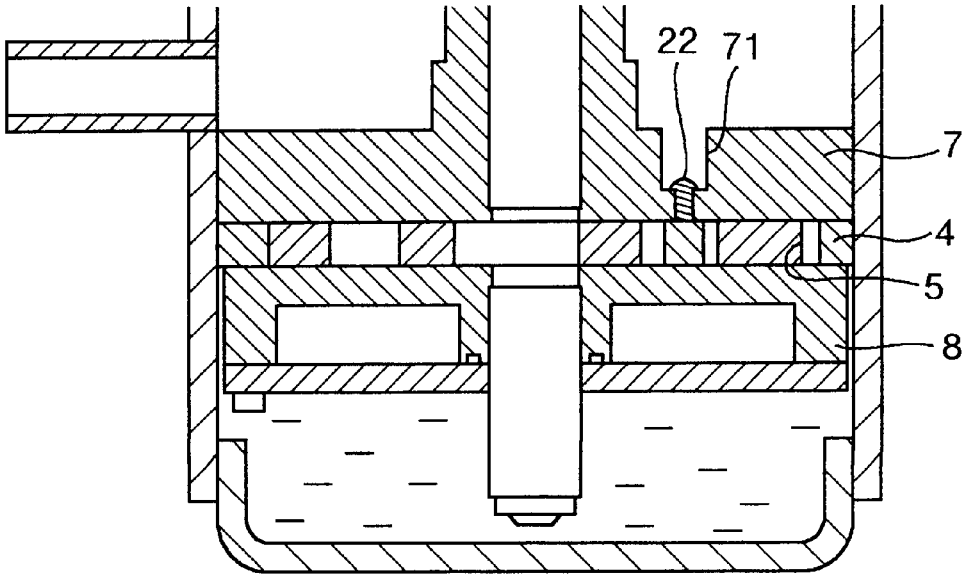
FIG. 20 is a view for explaining an embodiment in which a vane according to the present invention is fixed to an end plate.
Figure 21:
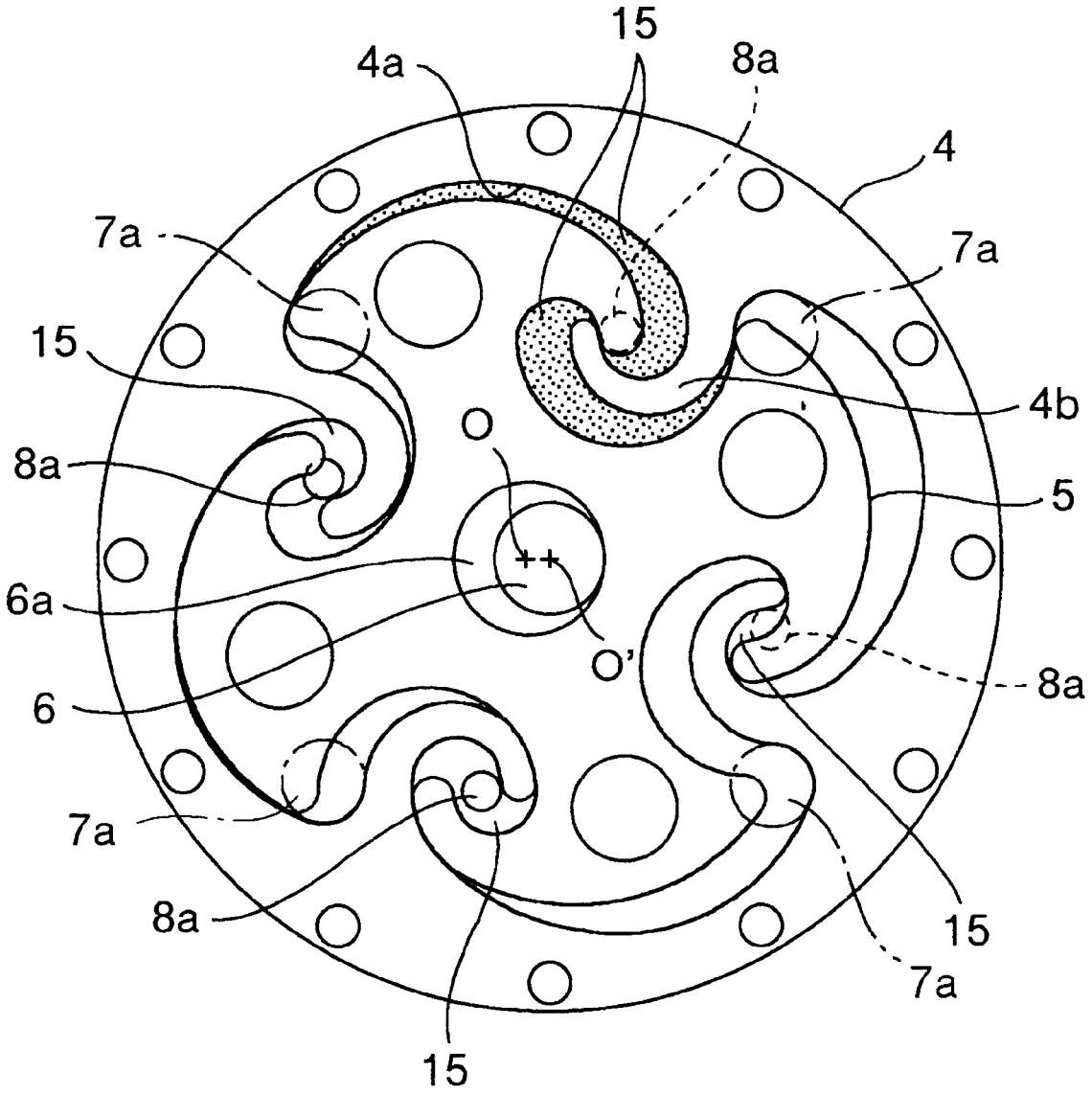
FIG. 21 is a view showing a compression element of a displacement type fluid machine according to another embodiment of the present invention in case of four working chambers.

Although it is required to process the vane 4*b* in the above embodiment, an embodiment in which the trouble is omitted will be described with reference to FIG. 20. A through hole 7*f* a portion of which near the vane 4*b* is smaller in diameter than the other portion is formed in the end plate 7 at the position opposite to the tip portion of the vane 4*b*. The end plate 7 and the tip portion of the vane 4*b* are fixed by spot welding or adhesion. 22 denotes a weld mark or a heat-resisting adhesive for metal. In this manner, there is an effect that the vane 4*b* can be fixed to one of the end plates only by a simple boring work and an adhering work of welding or with the adhesive.

Figure 22:
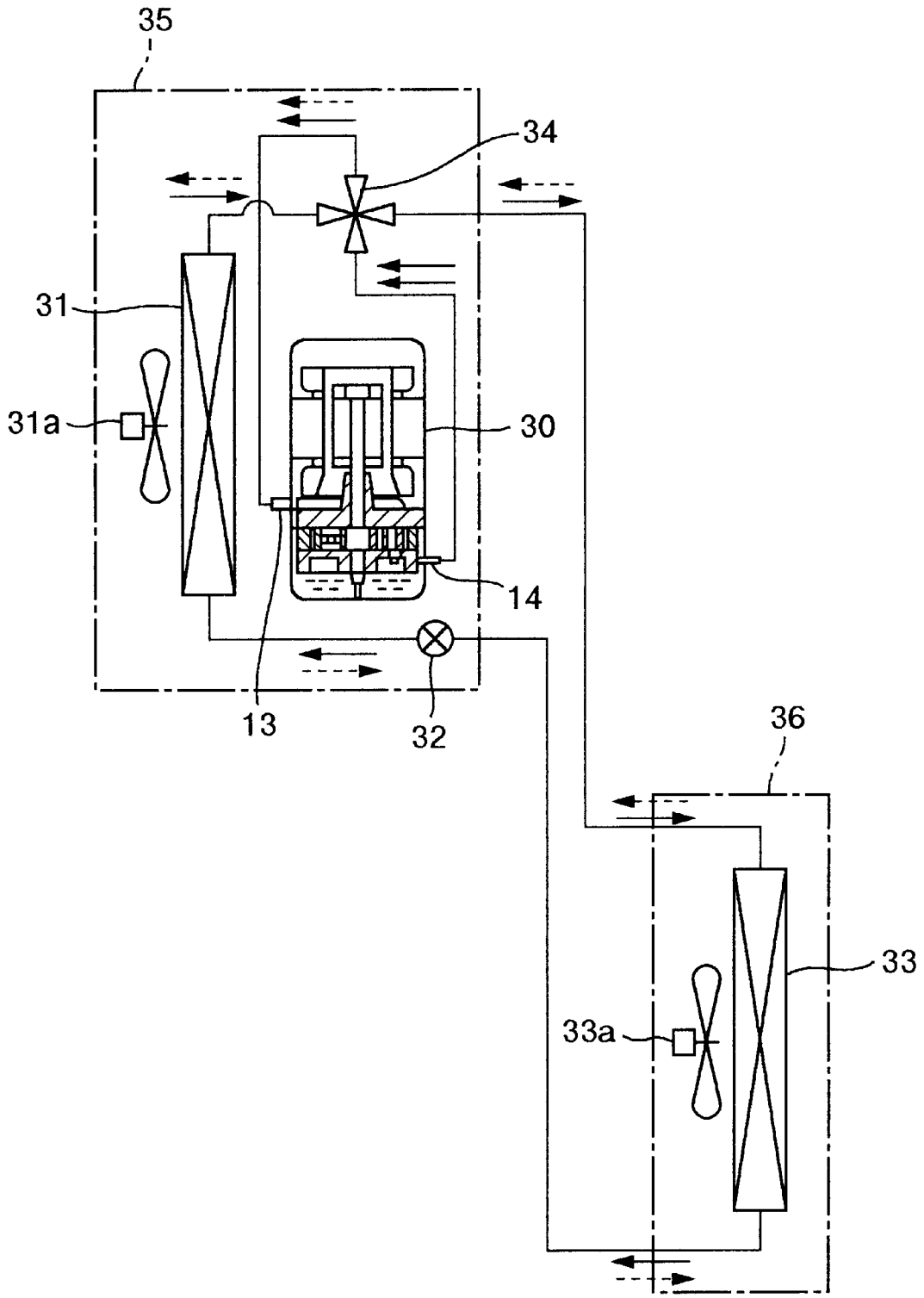
FIG. 22 is a view showing an air conditioner system employing a displacement type compressor of the present invention.

FIG. 22 shows the air conditioner system using the displacement type compressor of the present invention. This cycle is a heat pump cycle for a cooling and heating machine, and comprises a displacement type compressor 30 of the present invention shown in FIG. 3, an outdoor heat exchanger 31, a fan 31*a* of the outdoor heat exchanger 31, an expansion valve 32, an indoor heat exchanger 33, a fan 33*a* of the indoor heat exchanger 33, and four rectangular valve 34. A single-dot line 35 shows an outdoor unit, and a single-dot line 36 is an inside unit.

The displacement type compressor 30 is operated according to the principle of the work shown in FIGS. 2. The compressor is started so that the working fluid (HCFS22, R407C, R410A, etc.) is compressed between the cylinder and the displacer.

In case of operating the cooling machine, as shown by a dotted line arrow, the compressed working gas having the high temperature and high pressure passes through the four rectangular valve 34 from the discharge pipe 14, and flows into the outdoor heat exchanger 31. Further, the working gas is blown by the fan 31*a* so that the heat is radiated, the working gas is liquefied, is throttled by the expansion valve 32, is adiabatically expanded, is changed to the low temperature and low pressure, absorbs a heat in a room by the indoor heat exchanger 33, and is gasified. After then, the working gas passes through the suction pipe 13 and is sucked by the displacement type compressor 30. On the other hand, in case of operating the heating machine, as shown by a solid line arrow, the working gas is flowed back contrary to the cooling operation. The compressed working gas having the high temperature and high pressure passes through the four rectangular valve 34 from the discharge pipe 14, and flows into the indoor heat exchanger 33. Further, the working gas is blown by the fan 33*a* so that the heat is radiated, the working gas is liquefied, is throttled by the expansion valve 32, is adiabatically expanded, is changed to the low temperature and low pressure, absorbs the heat from an outside air by the outdoor heat exchanger 33, and is gasified. After then, the working gas passes through the suction pipe 13 and is sucked into the displacement type compressor 30.

Figure 23:
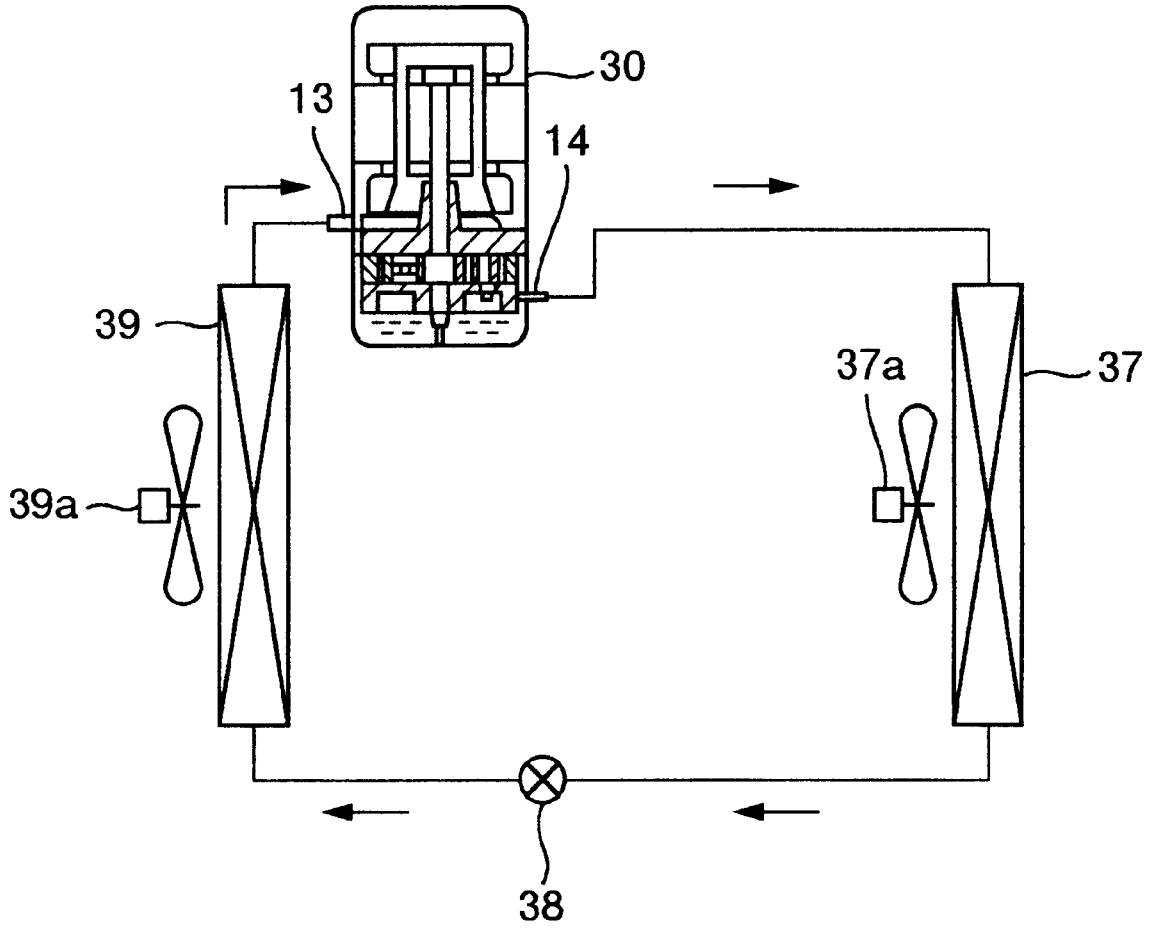
FIG. 23 is a view showing a cooling system employing a displacement type compressor of the present invention.

FIG. 23 shows the cooling system mounting the rotary type compressor of the present invention. This cycle is exclusively used for the refrigeration (cooling). In FIG. 23, a numeral 37 denotes a condenser, a numeral 37*a* denotes a condenser fan, a numeral 38 denotes an expansion valve, a numeral 39 denotes an evaporator, and a numeral 39 denotes an evaporator fan.

The displacement type compressor 30 is started so that the working fluid is compressed between the cylinder 4 and the displacer 5. As shown by the solid line, the compressed working gas having the high temperature and high pressure flows into the condenser 37 from the discharge pipe 14. Further, the working gas is blown by the fan 37*a* so that the heat is radiated, the working gas is liquefied, is throttled by the expansion valve 38, is adiabatically expanded, is changed to the low temperature and low pressure, absorbs a heat by the evaporator 39, and is gasified. After then, the working gas passes through the suction pipe 13 and is sucked by the displacement type compressor 30. Since the displacement type compressor is mounted to this system in FIGS. 22 and 23, it is possible to enhance the energy efficiency, to reduce the vibration and noise, and to obtain more reliable cooling and air conditioner system. Where, the low pressure type is exampled and explained as the displacement type compressor 30, further, the high pressure type can be also functioned similarly so that it is possible to obtain the same effects.

According to the above embodiment, the compressor and the pump are exampled as the displacement type fluid machine. Aside from these example, the present invention can be also applied to the expander and the motor machine. Also, according to the embodiment of the operation of the present invention, one side (the cylinder side) is fixed and the other side (the rotary piston) is not rotated, but gyrated around substantially constant gyrating radius. However, the present invention may be applied to the displacement type fluid machine for rotating both of sides according to the operation relatively equivalent to the above operation.

As described above in detail, the deterioration of the performance can be restrained in a practical operation according to the present invention.

What is claimed is:

1. A displacement type fluid machine comprising end plates, a displacer disposed between said end plates and having an outer wall surface, a rotating shaft around a center of rotation of which said displacer orbits, and a cylinder disposed between said end plates and having an inner wall surface within which said displacer is provided, said inner wall surface having portions protruded inwardly towards a center of said cylinder into a space formed by said inner wall surface of said cylinder and said end plates, wherein the inner and outer wall surfaces are shaped such that one space is provided between the inner wall surface of said cylinder and the outer wall surface of said displacer if a center of said displacer corresponds to the center of said cylinder, and a plurality of spaces are formed between the inner wall surface of said cylinder and the outer wall surface of said displacer when the center of said displacer is offset from the center of said cylinder, wherein said protruded portions of said inner wall surface are fixed to at least one of said end plates.

2. A displacement type fluid machine comprising end plates, a displacer disposed between said end plates and having an outer wall surface, a rotating shaft around a center of rotation of which said displacer orbits, and a cylinder disposed between said end plates and having an inner wall surface within which said displacer is provided, said inner wall surface having portions protruded inwardly towards a center of said cylinder into a space formed by said inner wall surface of said cylinder and said end plates, wherein the inner and outer wall surfaces are shaped such that one space is provided between the inner wall surface of said cylinder and the outer wall surface of said displacer if a center of said displacer corresponds to the center of said cylinder, and a plurality of spaces are formed between the inner wall surface of said cylinder and the outer wall surface of said displacer when the center of said displacer is offset from the center of said cylinder, wherein said machine further comprises a concave or convex portion formed in one of said protruded portions of said inner wall surface of said cylinder and a convex or concave portion formed in one of said end plates at the position opposite to said concave or convex portion of said one of the protruded portions.

3. A displacement type fluid machine comprising end plates, a displacer disposed between said end plates and having an outer wall surface, a rotating shaft around a center of rotation of which said displacer orbits, and a cylinder disposed between said end plates and having an inner wall surface within which said displacer is provided, said inner wall surface having portions protruded inwardly towards a center of said cylinder into a space formed by said inner wall surface of said cylinder and said end plates, wherein the inner and outer wall surfaces are shaped such that one space is provided between the inner wall surface of said cylinder and the outer wall surface of said displacer if a center of said displacer corresponds to the center of said cylinder, and a plurality of spaces are formed between the inner wall surface of said cylinder and the outer wall surface of said displacer when the center of said displacer is offset from the center of said cylinder, wherein said machine further comprises a groove formed in at least one of said end plates opposite to one of said protruded portions of said inner wall surface of said cylinder, and a retaining member inserted in said groove.

4. A displacement type fluid machine comprising end plates, a displacer disposed between said end plates and having an outer wall surface, a rotating shaft around a center of rotation of which said displacer orbits, and a cylinder disposed between said end plates and having an inner wall surface within which said displacer is provided, said inner wall surface having portions protruded inwardly toward a center of aid cylinder into a space formed by said inner wall surface of said cylinder and said end plates, wherein the inner and outer wall surfaces are shaped such that one space is provided between the inner wall surface of said cylinder and the outer wall surface of said displacer if a center of said displacer corresponds to the center of said cylinder, and a plurality of spaces are formed between the inner wall surface of said cylinder and the outer wall surface of said displacer when the center of said displacer is offset from the center of said cylinder, wherein a through hole is formed in one of said end plates opposite to one of said protruded portions of said inner wall surface of said cylinder, and said protruded portions are fixed to said one of the end plates through said through hole by welding or with an adhesive.

* * * * *